US012539895B2

(12) United States Patent
Mosby et al.

(10) Patent No.: US 12,539,895 B2
(45) Date of Patent: Feb. 3, 2026

(54) RAPID TRANSIT SYSTEM WITH WHEEL IN TRACK DESIGN

(71) Applicants: Robert Mosby, Felt, ID (US); Fred Mosby, Felt, ID (US)

(72) Inventors: Robert Mosby, Felt, ID (US); Fred Mosby, Felt, ID (US)

( * ) Notice: Subject to any disclaimer, the term of this patent is extended or adjusted under 35 U.S.C. 154(b) by 775 days.

(21) Appl. No.: 17/873,774

(22) Filed: Jul. 26, 2022

(65) Prior Publication Data

US 2023/0294743 A1 Sep. 21, 2023

Related U.S. Application Data

(63) Continuation-in-part of application No. 17/695,025, filed on Mar. 15, 2022, now Pat. No. 11,459,706.

(51) Int. Cl.

| | |
|---|---|
| ***B61F 5/52*** | (2006.01) |
| ***B61B 1/00*** | (2006.01) |
| ***B61F 9/00*** | (2006.01) |
| ***B61F 13/00*** | (2006.01) |
| ***E01B 25/10*** | (2006.01) |

(52) U.S. Cl.

CPC ..... *B61F 5/52* (2013.01); *B61B 1/00* (2013.01); *B61F 9/00* (2013.01); *B61F 13/00* (2013.01); *E01B 25/10* (2013.01)

(58) Field of Classification Search

CPC ..... B61F 5/52; B61F 9/00; B61F 5/02; B61F 13/00; B61F 3/00; E01B 25/10; E01B 2204/15; E01B 25/28; B61B 1/00; B61B 13/00

See application file for complete search history.

(56) References Cited

U.S. PATENT DOCUMENTS

| | | | | |
|---|---|---|---|---|
| 3,841,225 | A * | 10/1974 | Johnson | B61L 23/005 105/215.1 |
| 3,913,491 | A * | 10/1975 | Auer, Jr. | B61L 23/005 104/96 |
| 4,522,128 | A * | 6/1985 | Anderson | B61L 23/005 104/130.07 |
| 5,219,395 | A | 6/1993 | Spieldiener et al. | |
| 5,676,514 | A * | 10/1997 | Higman | B61C 11/04 414/339 |

(Continued)

FOREIGN PATENT DOCUMENTS

| | | | |
|---|---|---|---|
| CN | 213007442 U | * | 4/2021 |
| JP | 08332947 A | * | 12/1996 |

*Primary Examiner* — Cheng Lin

(57) ABSTRACT

A rapid transit system with wheel in track design includes a guideway, a vehicle that includes a vehicle bogie or chassis that couples to the guideway, and one or more terminals and/or intermediate stations. The guideway may include a first guideway and a second guideway, with a switch guideway interposed thereinbetween that allows the vehicle to move from the first guideway to the second guideway or vice versa. The vehicle may be coupled to the guideway via the vehicle bogie. The bogie may have a first axle, a second axle, and a third axle. First and second sets of guidewheels propel the vehicle forward or backward. The first set of switch wheels and/or the second set of switch wheels may be engaged and interact with one or more first or second neutral rails or first and second switch rails to move the vehicle from guideway to guideway.

19 Claims, 27 Drawing Sheets

(56) References Cited

U.S. PATENT DOCUMENTS

| | | | | |
|---|---|---|---|---|
| 7,644,664 | B2 * | 1/2010 | Nakao | B61B 13/04<br>104/243 |
| 7,997,540 | B2 | 8/2011 | Vance et al. | |
| 10,156,044 | B2 * | 12/2018 | Murase | E01B 25/28 |

* cited by examiner

RAPID TRANSIT SYSTEM WITH WHEEL IN TRACK DESIGN

CROSS-REFERENCE TO RELATED APPLICATIONS

This application is a continuation-in-part of U.S. Non-Provisional patent application Ser. No. 17/695,025 filed on Mar. 15, 2022, which is incorporated herein by reference.

TECHNICAL FIELD

The present disclosure relates to a rapid transit system. More particularly, the present disclosure relates to a wheel in track design for on vehicle switching for a rapid transit system.

BACKGROUND

Transportation has dramatically evolved over the last couple of centuries, from horses to supersonic passenger airplanes and everything in between. With the evolution in transportation technology, trains have also evolved. Trains were an important part of expanding the United States, and for many years, they were one of the few forms of transportation that could carry numerous passengers from east to west coast. Contemporary train-like transportation may include rapid transit whether underground, at ground level, or elevated. In addition, transportation via tracks is not only limited to trains but may also be found on roller coasters as well as in facilities utilizing conveyor belts. Many of these systems rely on switches to move the vehicle from one track to another, whether the switches are on board switching mechanisms or in track switching mechanisms.

No matter the location of the rapid transit, switches are essential so as to allow the train or vehicle to switch from one track to another. For a train to move from one track to another, requires a rail switch. These switches come in a variety of forms, such as single rail switches, driving rail switches, and equilateral rail switches. Switches often require complicated systems that utilize numerous tracks to move a train from one track to another. Other switching mechanisms are found on vehicles, meaning that switching is determined by mechanisms on the vehicle and not the tracks. Many of these vehicles use steered wheels to switch from track to track. These vehicles with steered wheels require heavier guideways and vehicles. Thus, these vehicles are limited in speed and braking ability. Steered wheels also increase design complexity and may not address potential derailment. Alternatives that use a switching rail are complex which increases costs, and could reduce reliability.

Accordingly, there is a need for a simple on vehicle switching mechanism that allows numerous speeds, increases braking ability, and decreases design complexity, thereby leading to decreased costs and increased safety. The present invention seeks to solve these and other problems.

SUMMARY OF EXAMPLE EMBODIMENTS

In one embodiment, a rapid transit system with wheel in track design (hereinafter referred to as a "rapid transit system") comprises a guideway, a vehicle that includes a vehicle bogie or chassis that couples to the guideway, and one or more terminals and/or intermediate stations. The guideway may be located at, above, or below grade, capable of fully or partially constraining the vehicle. The guideway may be designed so that it wraps around the vehicle or bogie, with guide rails positioned so that they will not interfere with switching rails. The guideway may comprise a first guideway and a second guideway, with a switch guideway interposed thereinbetween that allows the vehicle to move from the first guideway to the second guideway or vice versa. The first guideway may comprise a first sidewall, a second sidewall, a first base, and a first top side. The first guideway may comprise one or more first neutral guide rails that, in some embodiments, assist the vehicle in forward or backward movements along the first guideway. The first neutral guide rail may include a first protrusion extending from and perpendicular to the first sidewall so as to receive switch wheels.

The second guideway may comprise a third sidewall, a fourth sidewall, a second base, and a second top side. The second guideway may comprise one or more second neutral guide rails that, in some embodiments, moves the vehicle forward or backward along the second guideway. The second neutral guide rail may include a second protrusion extending from and perpendicular to the fourth sidewall. It will be appreciated that the first and second neutral guide rails allow the vehicle to be continuously coupled to the first or second guideways, which prevents derailments and allows the guideway and vehicle to be positioned upside down or sideways, for example, at an amusement park.

The switch guideway may be interposed between the first guideway and the second guideway. The switch guideway may be positioned at an angle between the first guideway and the second guideway to allow for smooth transition therebetween. The switch guideway may comprise a first switch sidewall, a second switch sidewall, a switch base, and a switch top side. The switch guideway may comprise two or more switch guide rails. In some embodiments, a first switch guide rail may include a first switch protrusion extending from and perpendicular to the first switch sidewall. A second switch guide rail may include a second switch protrusion extending from and perpendicular to the second switch sidewall. The first and second switch guide rails allow a vehicle to easily move from guideway to guideway.

The vehicle may be coupled to the guideway via the vehicle bogie. The bogie may be received by the guideway. The bogie may comprise a main support frame. Coupled to the main support frame may be a first axle, a second axle (e.g., a switch axle), and a third axle. To move the vehicle down the guideway, in normal operation, the first and second sets of guidewheels are positioned in the upper and lower corners or tracks of the guideway. The first and second sets of guidewheels propel the vehicle forward or backward. The first set of switch wheels and/or the second set of switch wheels may be engaged and interact with the one or more first or second neutral rails or first and second switch rails.

In one embodiment, a rapid transit system may comprise a guideway, which may comprise one or more neutral guide rails to interact with a first neutral wheel, one or more switch guide rails to interact with a first switch wheel, and one or more combination guide rails to interact with a second neutral wheel and a second switch wheel. A vehicle bogie may comprise the first neutral wheel, the first switch wheel, the second neutral wheel, the second switch wheel, and guide wheels that interact with guide rails or tracks in each corner of the guideway.

In one embodiment, a rapid transit system may comprise a guideway, which may comprise first combination guide rail and second combination guide rail. The first combination guide rail may protrude from a first sidewall and comprise a first neutral rail on a first upper surface and a first switch rail on a first lower surface. The second combination guide rail may protrude from a second sidewall and comprise a second neutral rail on a second upper surface and a second switch rail on a second lower surface. The first and second neutral rails may receive neutral wheels that are coupled to a vehicle bogie. The first and second switch rails may receive switch wheels that are coupled to the vehicle bogie. In addition, guide wheels that are coupled to the vehicle bogie may be positioned at an upper portion of the guideway and a lower portion of the guideway.

In one embodiment, a rapid transit system may comprise a guideway that may receive a vehicle bogie with a plurality of guidewheels. The guideway may comprise a first switch guide rail (e.g., switch to the left) and a second switch guide rail (e.g., switch to the right).

DETAILED DESCRIPTION OF EXAMPLE EMBODIMENTS

Figure 1:
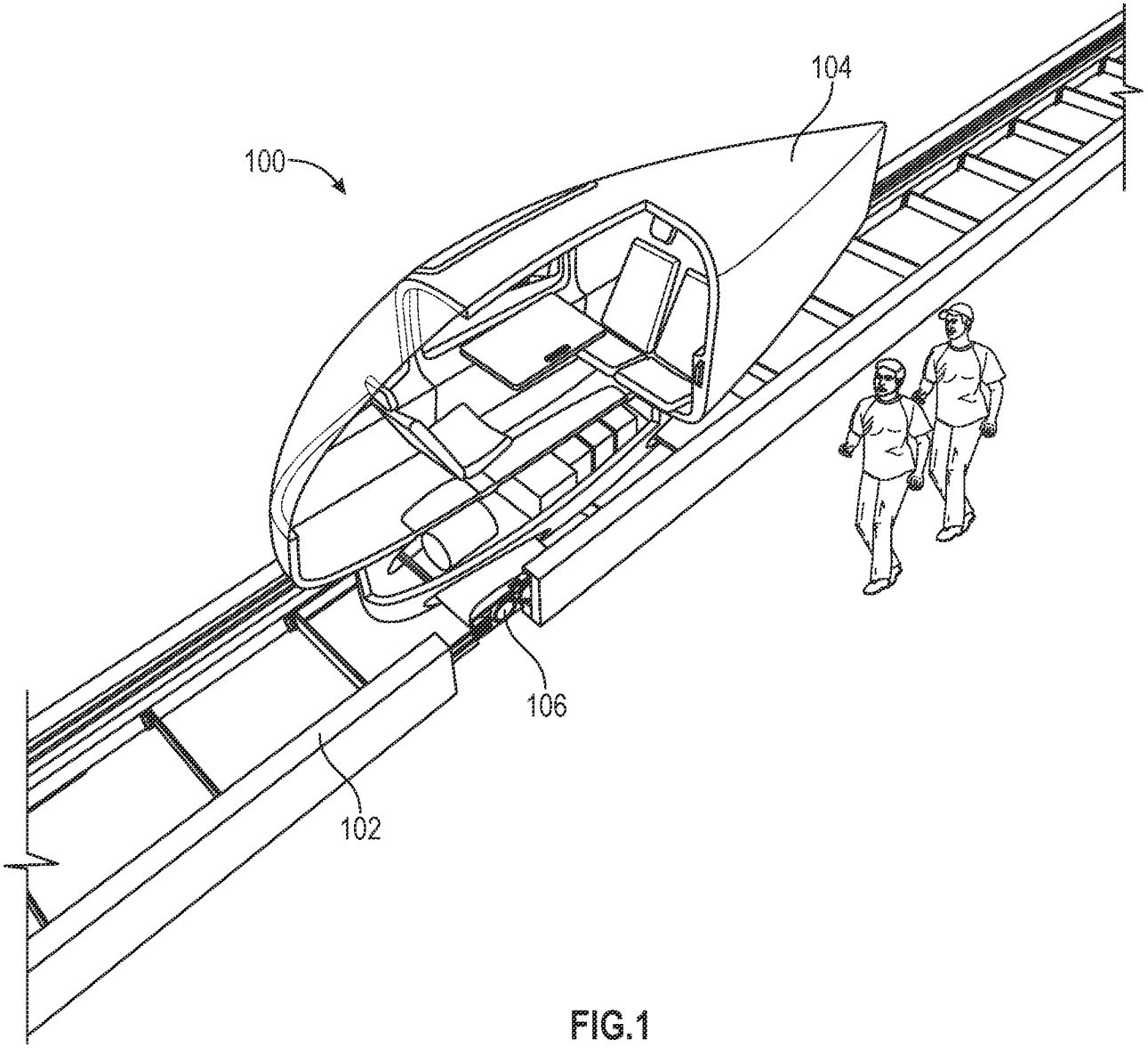
FIG. 1 illustrates a top, side perspective view of a vehicle on a guideway of a rapid transit system.

While embodiments of the present disclosure may be subject to various modifications and alternative forms, specific embodiments have been shown by way of example in the drawings and will be described in detail herein. However, the present disclosure is not intended to be limited to the particular features, forms, components, etc. disclosed. Rather, the present disclosure will cover all modifications, equivalents, and alternatives falling within the scope of the present disclosure.

Reference to the invention, the present disclosure, or the like are not intended to restrict or limit the invention, the present disclosure, or the like to exact features or steps of any one or more of the exemplary embodiments disclosed herein. References to "one embodiment," "an embodiment," "alternate embodiments," "some embodiments," and the like, may indicate that the embodiment(s) so described may include a particular feature, structure, or characteristic, but not every embodiment necessarily includes the particular feature, structure, or characteristic.

Any arrangements herein are meant to be illustrative and do not limit the invention's scope. Although specific terms are employed herein, they are used in a generic and descriptive sense only and not for purposes of limitation. Unless otherwise defined herein, such terms are intended to be given their ordinary meaning not inconsistent with that applicable in the relevant industry and without restriction to any specific embodiment hereinafter described.

It will be understood that the steps of any such processes or methods are not limited to being carried out in any particular sequence, arrangement, or with any particular graphics or interface. In fact, the steps of the disclosed processes or methods generally may be carried out in various, different sequences and arrangements while still being in the scope of the present invention. Certain terms are used herein, such as "comprising" and "including," and similar terms are meant to be "open" and not "closed" terms. These terms should be understood as, for example, "including, but not limited to."

As previously described, there is a need for a simple on vehicle switching mechanism that allows numerous speeds, increases braking ability, and decreases design complexity, thereby leading to decreased costs and increased safety. The present invention seeks to solve these and other problems.

Transportation continues to evolve as technology increases. Rapid transit has been important to many around the world, with it being the only means of transportation for some people throughout the world. These systems rely on complex switches to move a vehicle from one track to another, whether the switches are on board switching mechanisms or in track switching mechanisms. No matter the location of the rapid transit, switches are essential so as to allow the vehicle to switch from one track to another. Some switching mechanisms are found on vehicle, meaning that switching is determined by mechanisms on the vehicle and not the tracks. Many of these vehicles use steered wheels to switch from track to track. These vehicles with steered wheels require heavier guideways and vehicles. Thus, these vehicles are limited in speed and braking ability. Steered wheels also increase design complexity. Alternatives that use a switching rail are complex which increases costs, and could reduce reliability.

The rapid transit system described herein comprises a guideway and a vehicle with a bogie. The guideway may include a first guideway, a second guideway, and a switch guideway. The first and second guideways may have one or more neutral guide rails that interact with switching wheels on the vehicle bogie. In particular, a switch axle having switch wheels may adjust from a first position to a second position or vice versa via a switching mechanism to engage the one or more neutral guide rails or engage with switch rails, which will allow the vehicle to move to a different track and be continuously coupled to the guideway. It will be appreciated that the simple on-board switching mechanism allows the vehicle to move from guideway to guideway with moving guide wheels positioned on the bogie. In other words, all switching is provided by rails on the guideways and movement of the switch axle. It will also be appreciated that the configuration of the bogie and the guideway allows the vehicle and bogie to be operated upside, to the side, or at any other position.

As shown in FIG. 1, in one embodiment, rapid transit system 100 comprises a guideway 102, a vehicle 104 that includes a vehicle bogie 106 or chassis that couples to the guideway 102, and one or more terminals and/or intermediate stations. The guideway 102 may be located at, above, or below grade, capable of fully or partially constraining the vehicle 104. The guideway 102 may be designed so that it wraps around the vehicle 104 or bogie 106, with guide rails positioned so that they will not interfere with switching rails.

Figure 2:
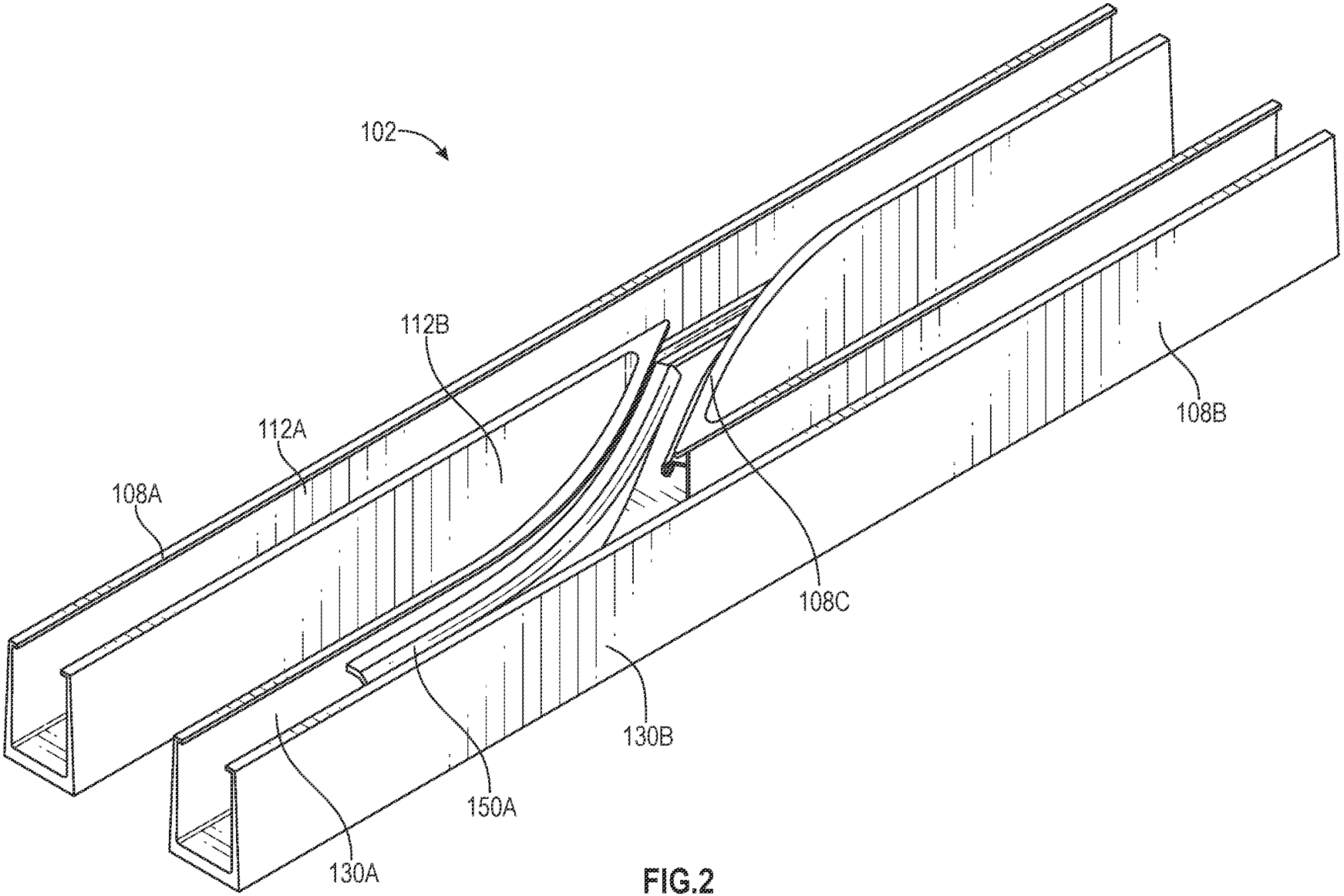
FIG. 2 illustrates a top, side perspective view of a guideway of a rapid transit system.
Figure 3:
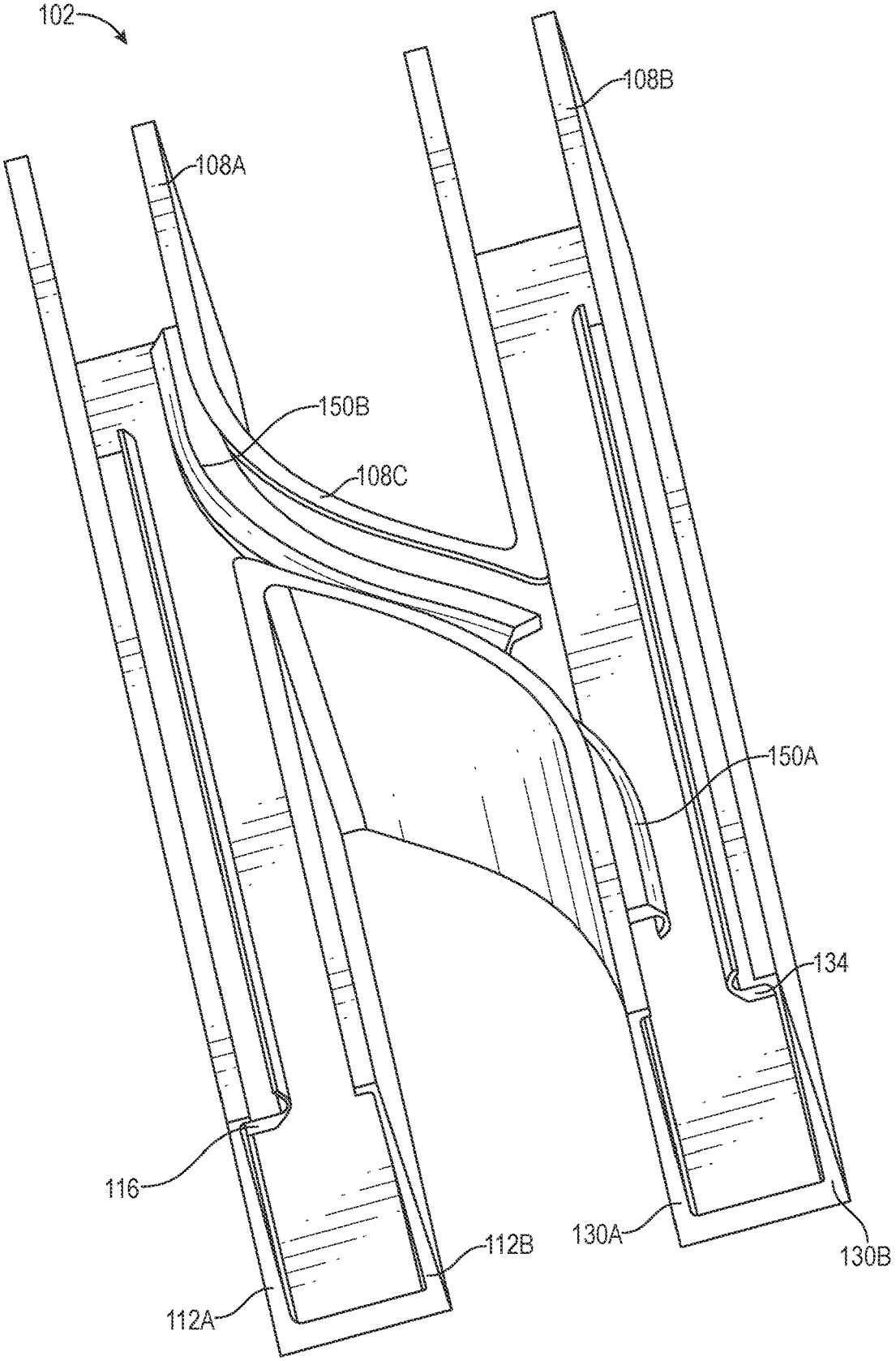
FIG. 3 illustrates a top, front perspective view of a guideway of a rapid transit system.
Figure 4:
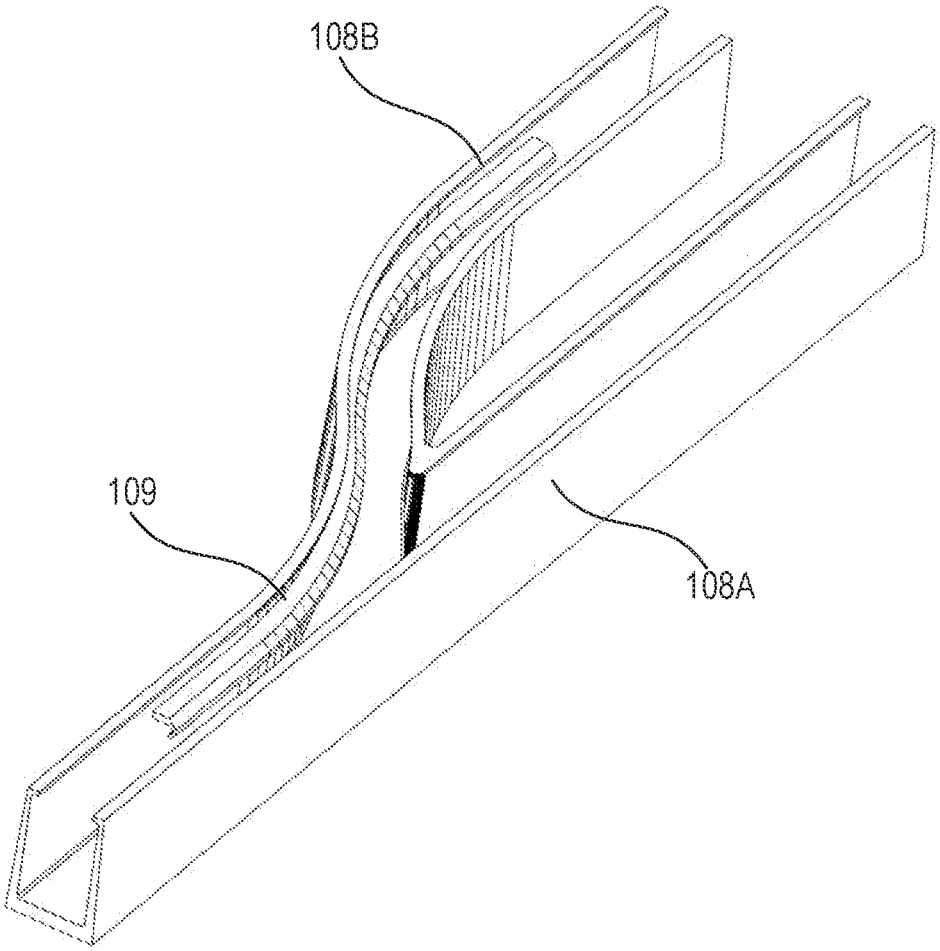
FIG. 4 illustrates a perspective view of a guideway of a rapid transit system.

As shown in FIGS. 2-4, the guideway 102 may comprise a first guideway 108A and a second guideway 108B, with a switch guideway 108C interposed thereinbetween that allows the vehicle 104 to move from the first guideway 108A to the second guideway 108B or vice versa. While only one first guideway 108A, second guideway 108B, and switch guideway 108C are shown, it will be understood that there may be any number of first guideways 108A, second guideways 108B, and switch guideways 108C in the guideway 102. As an example, one guideway may branch or couple to two or more guideways, or two guideways may merge into one. As shown in FIG. 4, in some embodiments, the first guideway 108A may branch directly into the second guideway 108B or merge from the second guideway 108B to the first guideway 108A, instead of having a switch guideway thereinbetween. However, the first and second guideway may comprise a branch switch rail 109, similar to those described below. It will be understood that any configuration of guideways may be utilized with the rapid transit system 100.

Figure 5:
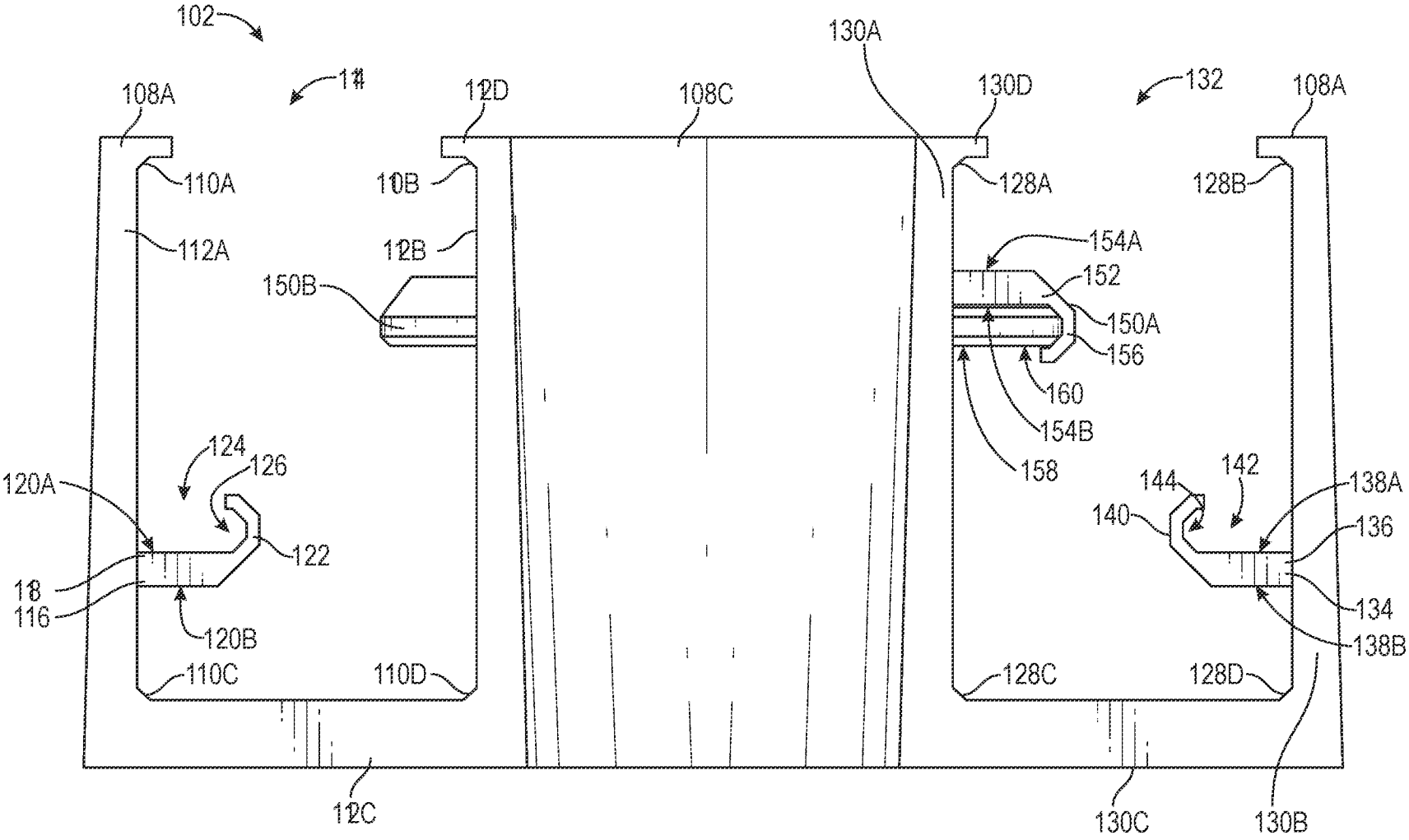
FIG. 5 illustrates a front elevation view of a guideway of a rapid transit system.
Figure 6:
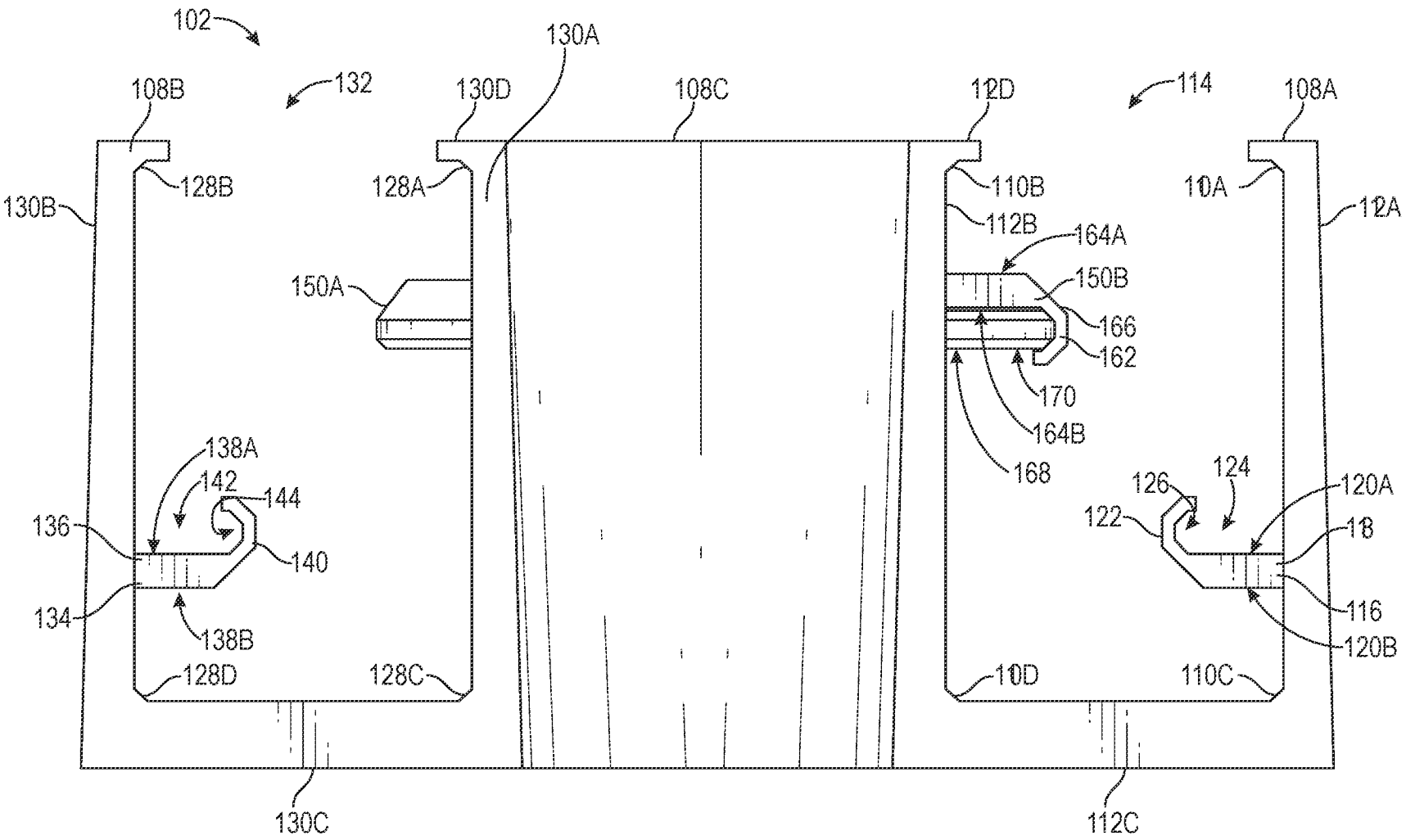
FIG. 6 illustrates a rear elevation view of a guideway of a rapid transit system.

As shown in FIGS. 5-6, the first guideway 108A may be rectangular shaped and have first angled corners (e.g., tracks) 110A-110D. Each angled corner 110A-110D may be capable of receiving guide wheels of the vehicle bogie 106, as discussed below. While a rectangular shape is illustrated, other shapes may be envisioned, such as ovular. It will also be appreciated that while the corners 110A-110D are shown as angled, in some embodiments, the corners 110A-110D may not be angled. The first guideway 108A may comprise a first sidewall 112A, a second sidewall 112B, a first base 112C, and a first top side 112D. The first top side 112D may comprise a first guideway opening 114 so as to receive the vehicle bogie 106. The first guideway 108A may comprise one or more first neutral guide rails 116 that, in some embodiments, assist the vehicle 104 in forward or backward movements along the first guideway 108A. The first neutral guide rail 116 may include a first protrusion 118 extending from and perpendicular to the first sidewall 112A. However, it will be appreciated, in one embodiment, that the first neutral guide rail 116 may be placed on the second sidewall 112B, alone or in conjunction with the first neutral guide rail 116 on the first sidewall 112A. The first protrusion 118 may comprise an upper surface 120A and a lower surface 120B. The first protrusion 118, at an end opposite insertion into the first sidewall 112A, may have a first hook 122 extending upward therefrom and back toward the first sidewall 112A that creates a first protrusion aperture 124 and a first protrusion channel 126.

The second guideway 108B may be rectangular shaped and have second angled corners (e.g., tracks) 128A-128D. Each angled corner 128A-128D may be capable of receiving guide wheels of the vehicle bogie 106, as discussed below. While a rectangular shape is illustrated, other shapes may be envisioned, such as ovular. It will also be appreciated that while the corners 128A-128D are shown as angled, in some embodiments, the corners 128A-128D may not be angled. The second guideway 108B may comprise a third sidewall 130A, a fourth sidewall 130B, a second base 130C, and a second top side 130D. The second top side 130D may comprise a second guideway opening 132 so as to receive the vehicle bogie 106. The second guideway 108B may comprise one or more second neutral guide rails 134 that, in some embodiments, assists the vehicle 104 moving forward or backward along the second guideway 108B. The second neutral guide rail 134 may include a second protrusion 136 extending from and perpendicular to the fourth sidewall 130B. However, it will be appreciated that the second neutral guide rail 134 may be placed on the third sidewall 130A alone or in conjunction with the second neutral guide rail 134 on the fourth sidewall 130B. The second protrusion 136 may comprise an upper surface 138A and a lower surface 138B. The second protrusion 136, at an end opposite insertion into the fourth sidewall 130B, may have a second hook 140 extending upward therefrom and back toward the fourth sidewall 130B that creates a second protrusion aperture 142 and a second protrusion channel 144. It will be appreciated that the first and second neutral guide rails 116, 134 allow the vehicle 104 to be continuously coupled to the first or second guideways 108A, 108B, which prevents derailments and allows the guideway 102 to be positioned upside down or sideways, for example, at an amusement park.

Figure 7:
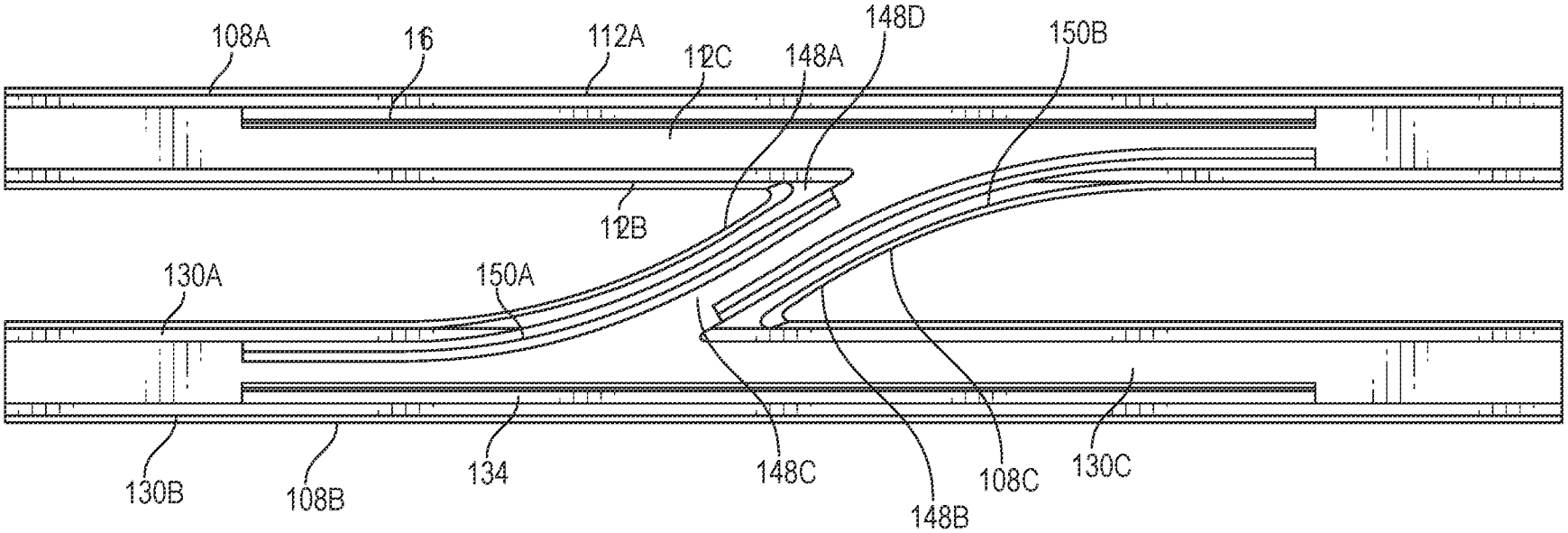
FIG. 7 illustrates a top plan view of a guideway of a rapid transit system.

As illustrated in FIG. 7, the switch guideway 108C may be interposed between the first guideway 108A and the second guideway 108B. The switch guideway 108C may be positioned at an angle between the first guideway 108A and the second guideway 108B to allow for smooth transition therebetween. While the switch guideway 108C is illustrated as having a slight angle, it will be appreciated that in some embodiments, the switch guideway 108C may be at a steeper angle or perpendicular to the first and second guideways 108A, 108B. The switch guideway 108C may comprise a first switch sidewall 148A, a second switch sidewall 148B, a switch base 148C, and a switch top side 148D. The first switch sidewall 148A may be coupled to the third sidewall 130A at one end and coupled to the second sidewall 112B at an opposite end. The second switch sidewall 148B may be coupled to the third sidewall 130A at one end and coupled to the second sidewall 112B at an opposite end. Referring back to FIGS. 4-5, the switch guideway 108C may comprise two or more switch guide rails. In some embodiments, a first switch guide rail 150A may include a first switch protrusion 152 extending from and perpendicular to the first switch sidewall 148A and the third sidewall 130A. The first switch protrusion 152 may comprise an upper surface 154A and a lower surface 154B. The first switch protrusion 152, at an end opposite insertion into the first switch sidewall 148A and third sidewall 130A, may have a first switch hook 156 extending downward therefrom and back toward the first switch sidewall 148A and third sidewall 130A that creates a first switch aperture 158 and a first switch channel 160. In some embodiments, a second switch guide rail 150B may include a second switch protrusion 162 extending from and perpendicular to the second switch sidewall 148B and the second sidewall 112B. The second switch protrusion 162 may comprise an upper surface 164A and a lower surface 164B. The second switch protrusion 162, at an end opposite insertion into the second switch sidewall 148B and the second sidewall 112B, may have a second switch hook 166 extending upward therefrom and back toward the second switch sidewall 148B and second sidewall 112B that creates a second switch aperture 168 and a second switch channel 170. Further, the first and/or second switch guide rails 150A, 150B may include a locking rail to prevent the switch 186B, discussed below, on the bogie from inadvertently changing position during a switch.

The guideway 102 may be designed for vehicles 104A-104C to ride inside, above, below, to the side, or at various positions in relation to the guideway 102. In some embodiments, the guideway 102 may include a system for wireless power transmission to vehicles 104, or an energized rail to provide direct electric power. In some embodiments, the guideway 102 may include an additional brake rail to allow brakes to be applied directly to the guideway 102. In some embodiments, the guideway 102 may include markings or wireless transmitters for the purpose of locating vehicles on the guideway 102. The guideway 102 may include wireless data transmitters and receivers to allow vehicles to communicate with each other or a centralized control system, and to provide Internet access to passengers.

Figure 8:
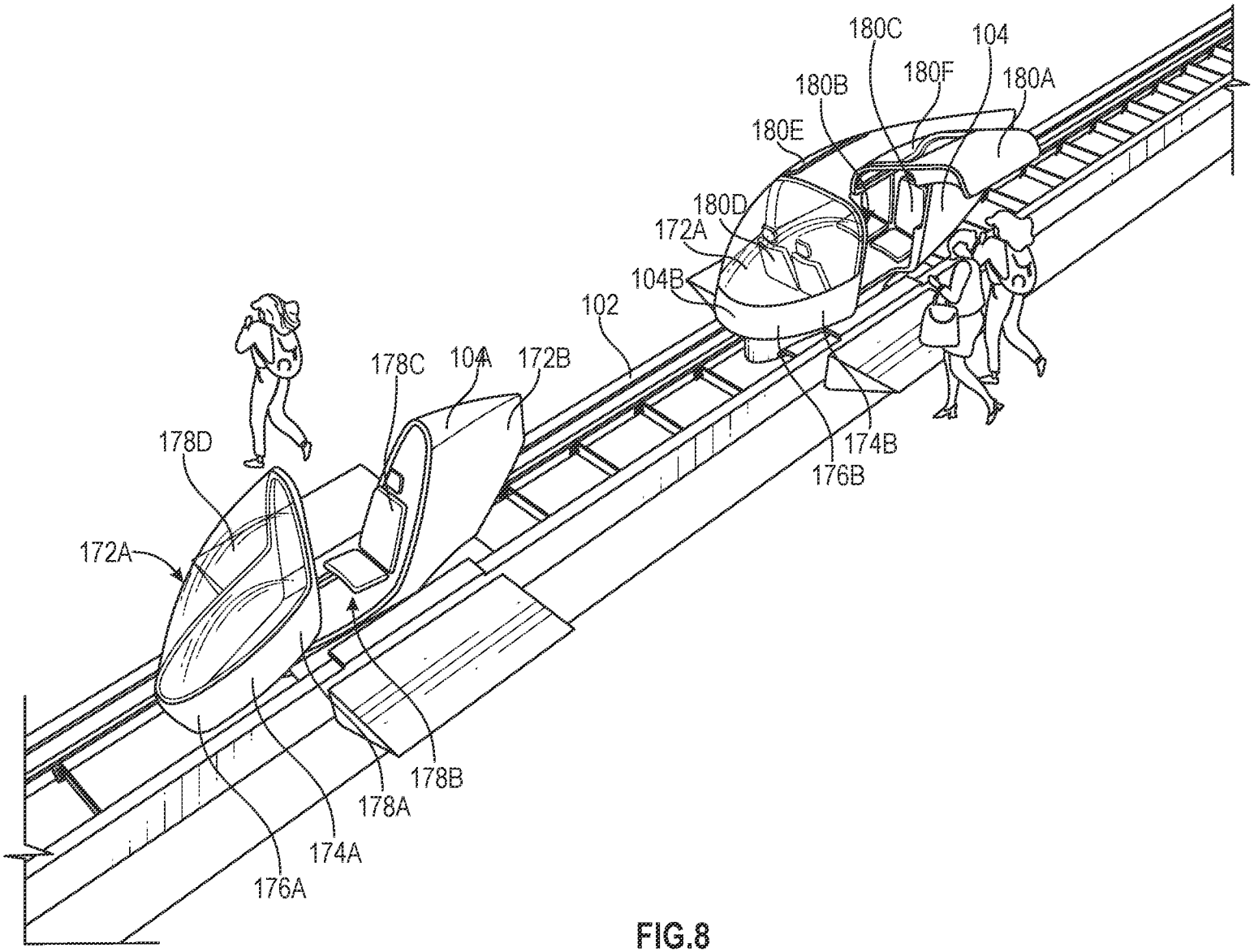
FIG. 8 illustrates a top, side perspective view of vehicles on a guideway of a rapid transit system.
Figure 9:
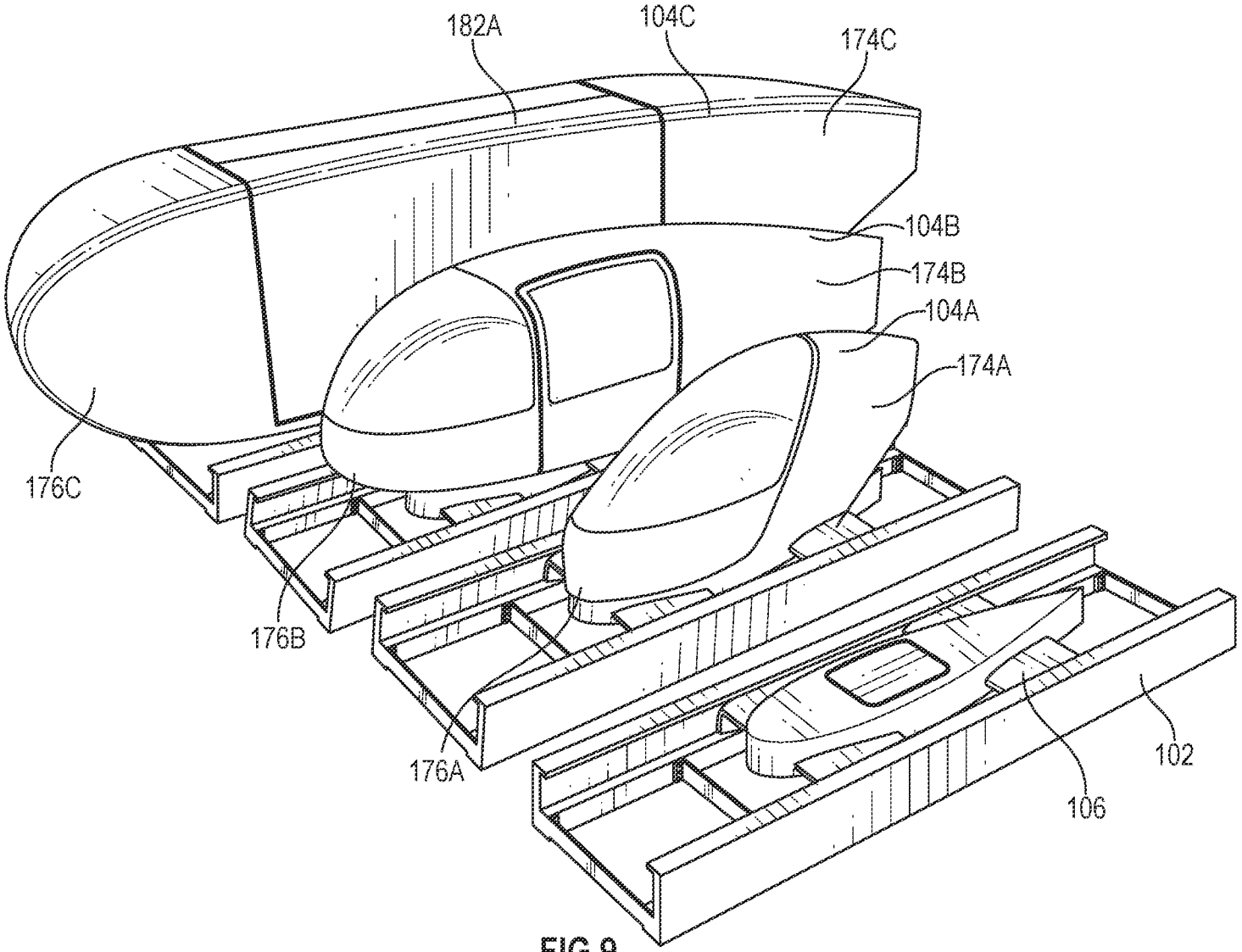
FIG. 9 illustrates a perspective view of vehicles on a guideway of a rapid transit system.

As shown in FIGS. 8-9, the guideway 102 may comprise one or more vehicles 104A-104C, which may be self-propelled. The vehicles 104 may be designed to interface with the guideway 102. The vehicle 104A-104C may comprise a vehicle body. The vehicle body may comprise a front portion 172A that is rounded and a rear portion 172B that is tapered so as to assist in aerodynamics and decrease material. It will be understood that the vehicle 104 may come in a variety of sizes. For example, the vehicle 104 may come in a first body 174A, a second body 174B, or a third body 174C. The first body 174A may comprise a first size 176A, the second body 174B may comprise a second size 176B, and the third body 174C may comprise a third size 176C. The first size 176A may be smaller than the second size 176B and the third size 176C. The second size 176B may be smaller than the third size 176C. While three body sizes and shapes are shown, it will be appreciated that any number of body shapes or sizes may be used with the rapid transit system 100.

In some embodiments, the first body 174A may comprise at least one door 178A that allows entrance into an interior compartment 178B, which may include at least one passenger seat 178C. The first body 174A may comprise a first window 178D on the front portion 172A of the vehicle 104A. The first body 174A may be used with at least one passenger. In some embodiments, the second body 174B, may comprise one or more doors 180A allowing access to an interior compartment 180B, which may include one or more passenger seats 180C. The second body 174B may comprise a front window 180D in the front portion 172A and a first side window 180E and a second side window 180F. The third body 174C, in some embodiments, may comprise one or more doors 182A allowing access to an interior compartment including one or more passenger seats. The third body 174C as illustrated may not have windows; however, it could be envisioned that in some embodiments, the third body may have windows. The third body 174C may be utilized when numerous passengers need to be transported. It will be appreciated that the vehicle 104 is not limited to carrying passengers and may also carry cargo and carry out maintenance functions on the guideway 102 with or without a driver in a point-to-point fashion without being required to stop or transfer at intermediate points.

The vehicle 104A-104C, no matter if it is the first, second, or third body 174A-174C, can be coupled to the guideway 102. The guideway 102 may comprise vehicles 104A-104C with the first, second, and third bodies 174A-174C at the same time coupled thereto.

Figure 10:
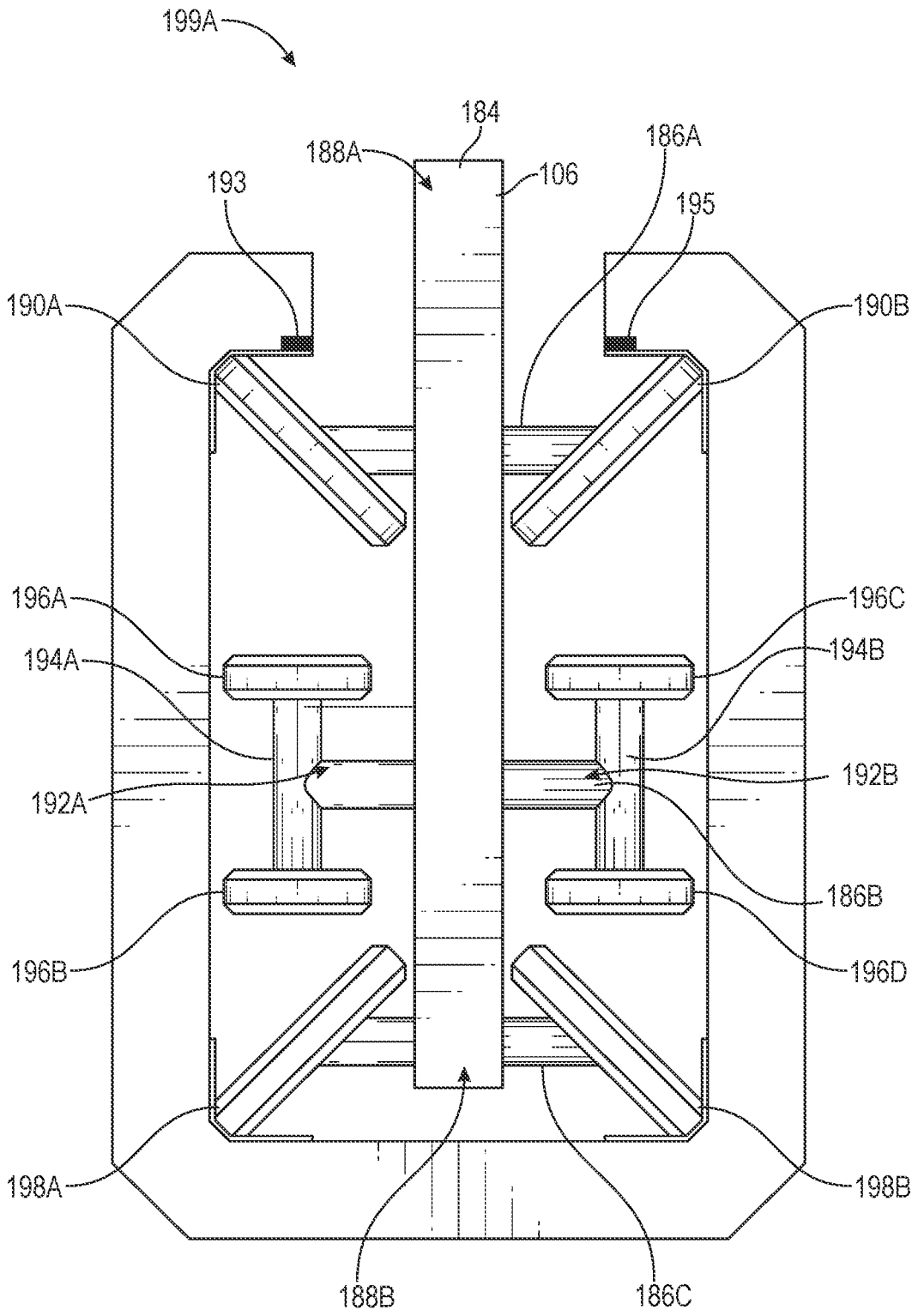
FIG. 10 illustrates a front elevation view of a vehicle bogie in a guideway of a rapid transit system.
Figure 11:
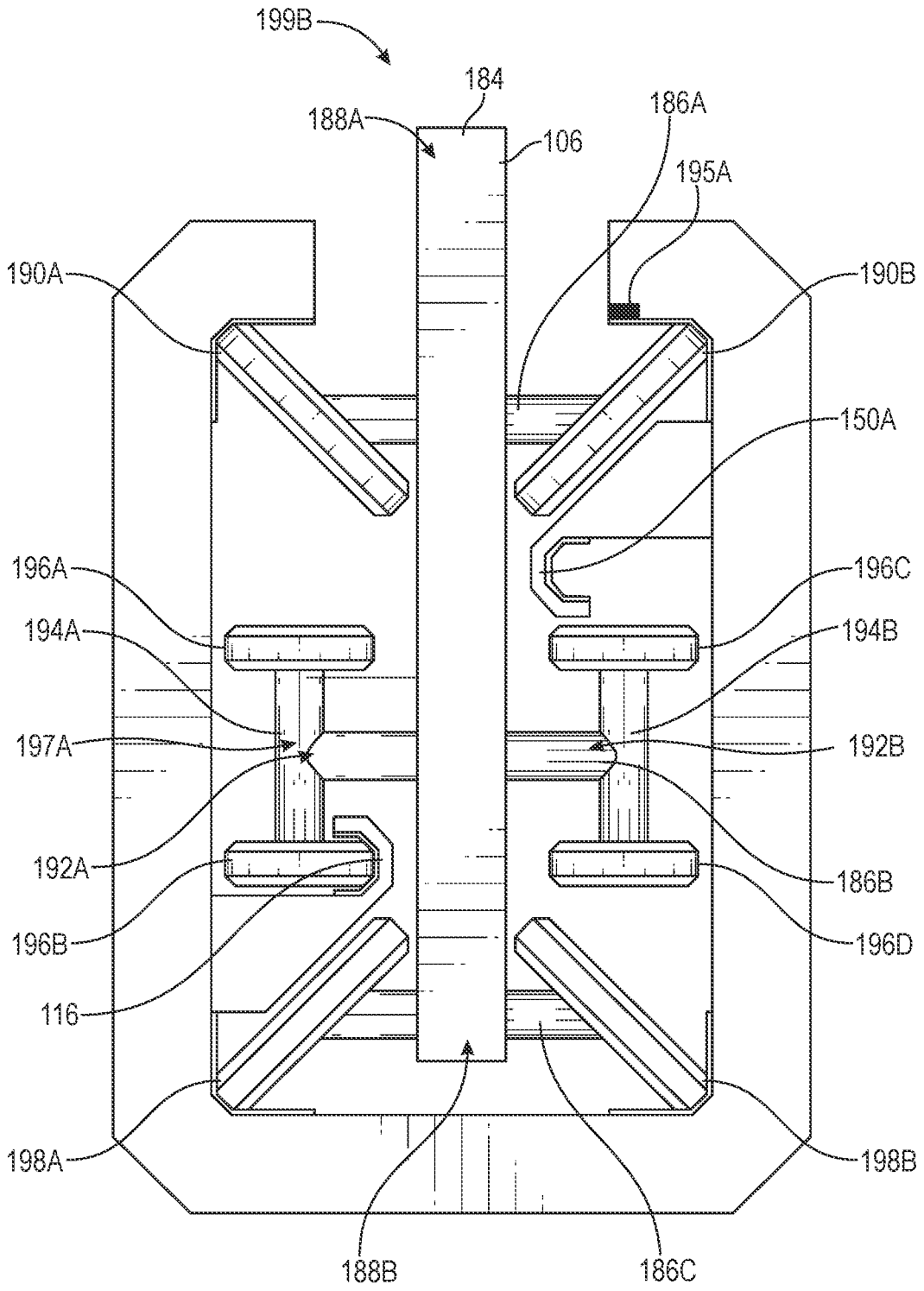
FIG. 11 illustrates a front elevation view of a vehicle bogie in a guideway of a rapid transit system.
Figure 12:
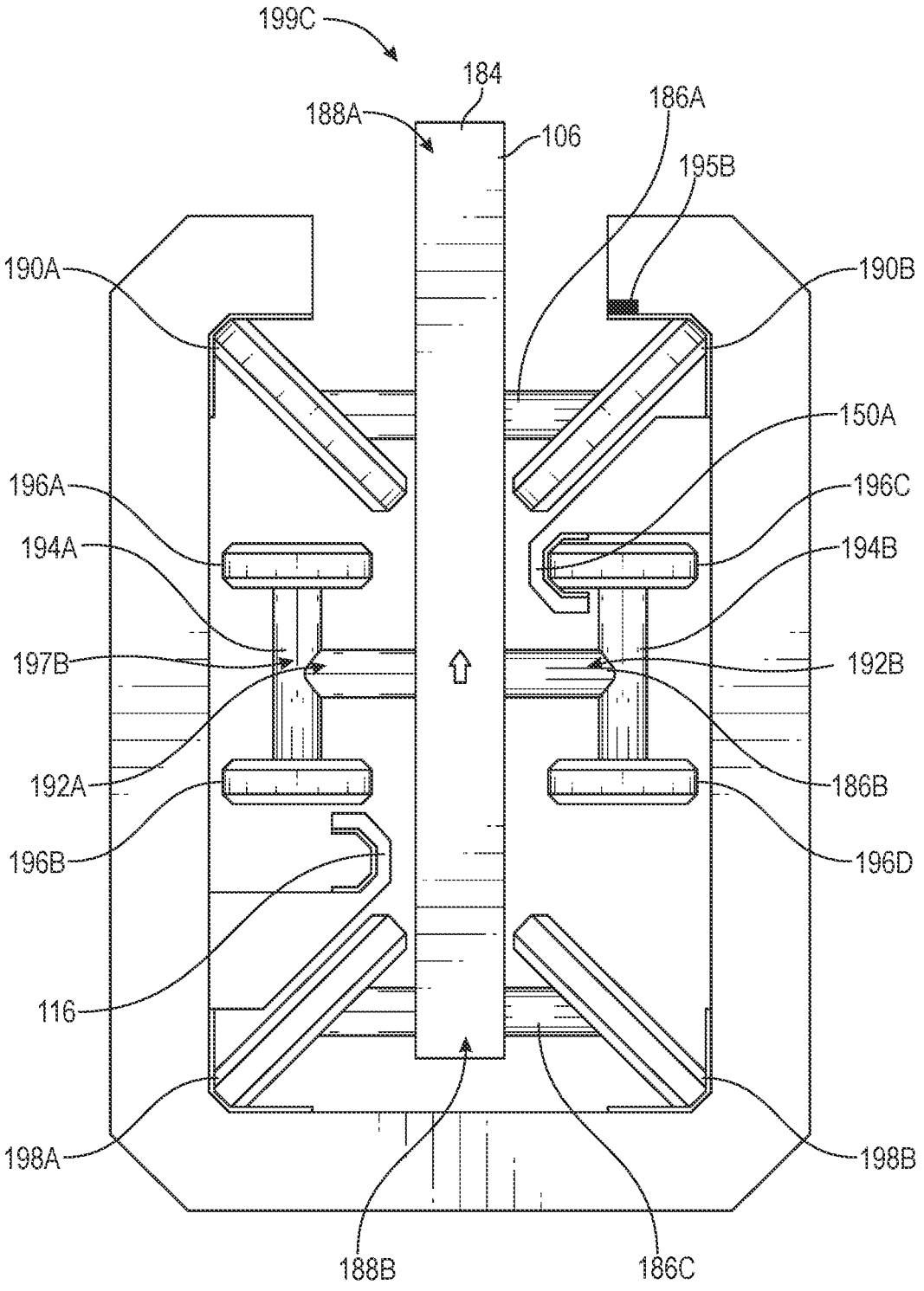
FIG. 12 illustrates a front elevation view of a vehicle bogie in a guideway of a rapid transit system.

As shown in FIGS. 10-12, the vehicle 104 may be coupled to the guideway via the vehicle bogie 106. In some embodiments, there may be more than one bogie coupled to a vehicle. For example, small vehicles may comprise a single bogie while larger vehicles comprise one or more. The bogie 106 may be received by the guideway 102. In particular, the bogie 106 may be placed through the first guideway opening 114 or second guideway opening 132. The bogie 106 may comprise a main support frame 184. Coupled to the main support frame 184 may be a first axle 186A, a second axle 186B (e.g., a switch axle), and a third axle 186C. While axles are illustrated, it could be envisioned that other embodiments include wheels without the aid of an axle, such as hydraulic direct wheel drive systems or any other system not involving an axle. For example, in some embodiments, wheels may be coupled to an independent support frame or an aero-structure instead of an axle. With that being said, in some embodiments, a switch may occur when switch wheels as described below are engaged with switch guide rails. The first axle 186A may be perpendicular to the main support frame 184 and coupled thereto at an upper portion 188A of the main support frame 184. The first axle 186A may comprise a first set of guide wheels 190A, 190B that interact with upper corners 110A-110D, 128A-128D (shown in FIGS. 5-6) in the guideway 102. In some embodiments, the first set of guide wheels 190A, 190B may be at an angle (e.g., at an obtuse and/or an acute angle) to match the angle of the upper corners 110A-110D, 128A-128D. In some embodiments, the first set of guide wheels 190A, 190B may be parallel with the sidewalls 112A, 112B, 130A, 130B (shown in FIGS. 4-5) of the guideway 102. In an alternate embodiment, the first set of guide wheels 190A, 190B may be perpendicular to the sidewalls 112A, 112B, 130A, 130B of the guideway 102.

The second axle 186B may be coupled perpendicularly to the main support frame 184. At a first end 192A of the second axle 186B, there may be, coupled thereto, a first switch axle 194A that is perpendicular to the second axle 186B. The first switch axle 194A may comprise a first set of switch wheels 196A, 196B to interact with the one or more first and second neutral rails 116, 134 and switch rails 150A, 150B. At a second end 192B, opposite the first end 192A, there may be, coupled thereto, a second switch axle 194B that is perpendicular to the second axle 186B. The second switch axle may comprise a second set of switch wheels 196C, 196D to interact with the one or more first and second neutral rails 116, 134 and switch rails 150A, 150B. The second axle 186B may raise and lower so as to engage with the neutral rails 116, 134 and the switch rails 150A, 150B.

The third axle 186C may be perpendicular to the main support frame 184 and coupled thereto at a lower portion 188B of the main support frame 184. The third axle 186C may comprise a second set of guide wheels 198A, 198B that interact with lower corners in the guideway 102. In some embodiments, the second set of guide wheels 198A, 198B may be at an angle (e.g., at an obtuse and/or a reflex angle) to match the angle of the lower corners. In some embodiments, the second set of guide wheels 198A, 198B may be parallel with the sidewalls 112A, 112B, 130A, 130B of the guideway 102. In an alternate embodiment, the second set of guide wheels 198A, 198B may be perpendicular to the sidewalls 112A, 112B, 130A, 130B of the guideway 102.

While certain number of guidewheels 190A-190B, 198A-198B and switch wheels 196A-196D are illustrated, in some embodiments, there may be more or less guidewheels and switch wheels than what is illustrated, such as four first guidewheels, four second guidewheels, and two switch wheels.

To move the vehicle 104A-104C down the guideway 102, in normal operation 199A, the first and second sets of guidewheels 190A, 190B, 198A, 198B are positioned in the upper and lower corners or tracks 110A-110D, 128A-128D of the guideway 102, respectively. The first and second sets of guidewheels 190A, 190B, 198A, 198B propel the vehicle 104A-104C forward or backward. In normal operations, as shown in FIG. 10, the vehicle 104A-104C is capable of forward or rearward movement while not interacting with the one or more first or second neutral rails 116, 134. However, in some embodiments, the vehicle 104A-104C and more particularly, the first set of switch wheels 196A, 196B and/or the second set of switch wheels 196C, 196D may be engaged and interact with the one or more first or second neutral rails 116, 134 while in normal operation. When the vehicle 104A-104C is engaged with the one or more first or second neutral rails 116, 134, it is coupled and secured to the guideway 102, thereby preventing derailment and allowing the vehicle 104A-104C to be operated in numerous positions, such as sideways or upside down (e.g., in positions found at amusement parks).

In a neutral position 199B, as shown in FIG. 11, when the first set of switch wheels 196A, 196B and/or the second set of switch wheels 196C, 196D are engaged with the one or more first or second neutral rails 116, 134, the vehicle 104A-104C is moving straight during the switch. The neutral position 199B may be when the second axle 186B is in a first position 197A (e.g., a down position). It will be appreciated that the first position 197A acts as a failsafe to secure the vehicle 104A-104C to the guideway 102 due to gravity affecting the second axle 186B, pulling it downward. However, it will be understood that depending on the orientation of the vehicle 104A-104C, in some embodiments, the second axle 186B may be in the neutral position 199B when in a second position 197B (e.g., an up position).

Figure 14:
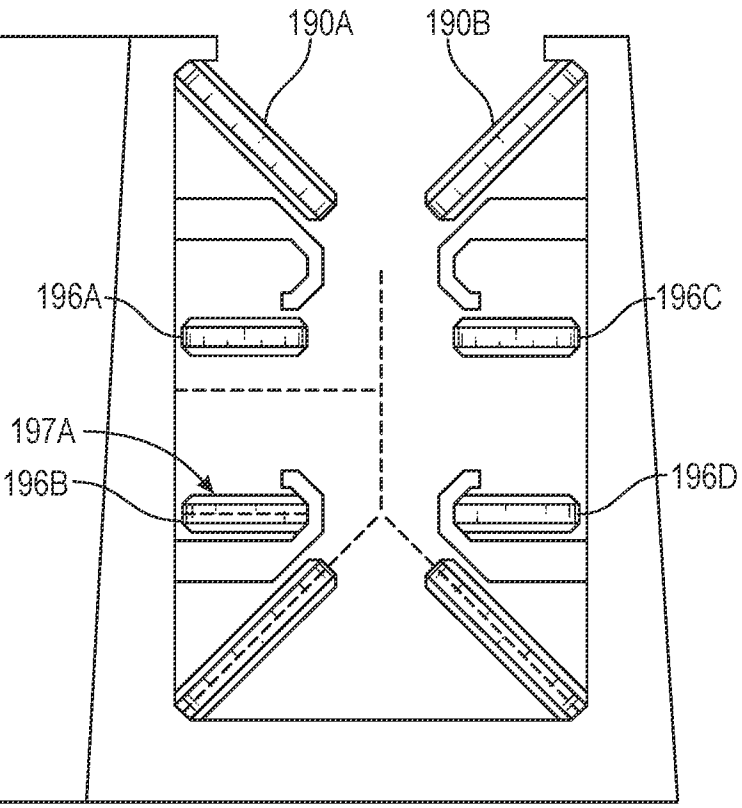
FIG. 14 illustrates a front elevation view of a vehicle bogie of a rapid transit system in a neutral position.
Figure 13:
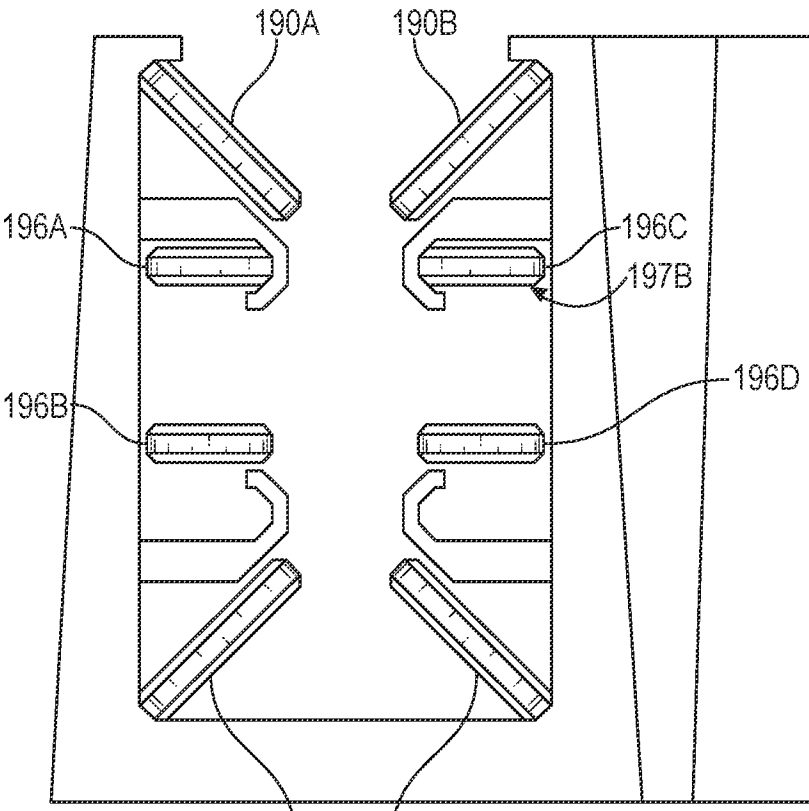
FIG. 13 illustrates a front elevation view of a vehicle bogie of a rapid transit system in an active position.
Figure 15:
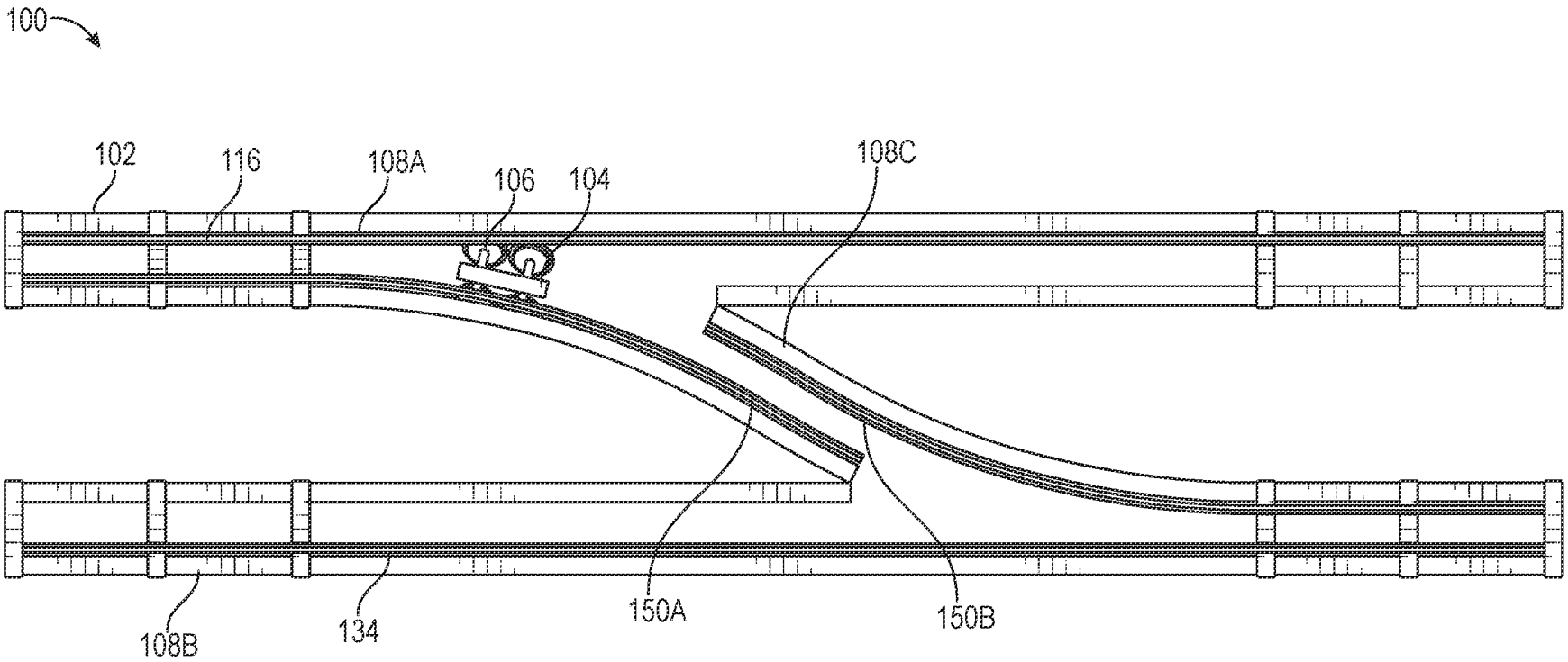
FIG. 15 illustrates a top plan view of a vehicle switching from a first guideway to a second guideway on a rapid transit system.

In the switch or active position 199C, as shown in FIG. 12, the second axle 186B may move upward to interact and be engaged with the switch rails 150A, 150B. The second axle 186B may be moved via a motor, push force by the neutral or switch guide rails, an actuator, or any other type of switching mechanism to move the second axle upward or downward. Once engaged with the switch rails 150A, 150B, the vehicle 104A-104C may make a right turn, or in some embodiments, a left turn. For example, as shown in FIG. 13-14, when the second axle 186B is in the first position 197A, it is engaged with the first or second neutral rails 116, 134 and moves the vehicle 104A-104C straight along the guideway 108A, 108B. As shown in FIG. 15, when the second axle 186B is in the second position 197B, it becomes engaged with the switch rails 150A, 150B, moving the vehicle 104A-104C from the first guideway 108A to the switch guideway 108C and then to the second guideway 108B, or vice versa. By switching up and down, the second axle 186B switches between the neutral and the active position 199B, 199C, rather than selecting a direction of motion. It will be appreciated that the bogies 106 are positioned inside the guideway 102 so that the active/neutral or a left/right switching system integrated into the vehicle or bogie can continuously interface with a switching rail outside the path of the guide rails in order to transition from the first guideway 108A to the second guideway 108B. The rapid transit system 100 can also be applied to left and right switching, working the same way as the active and neutral positions 199C, 199B, but with fewer benefits.

Figure 16:
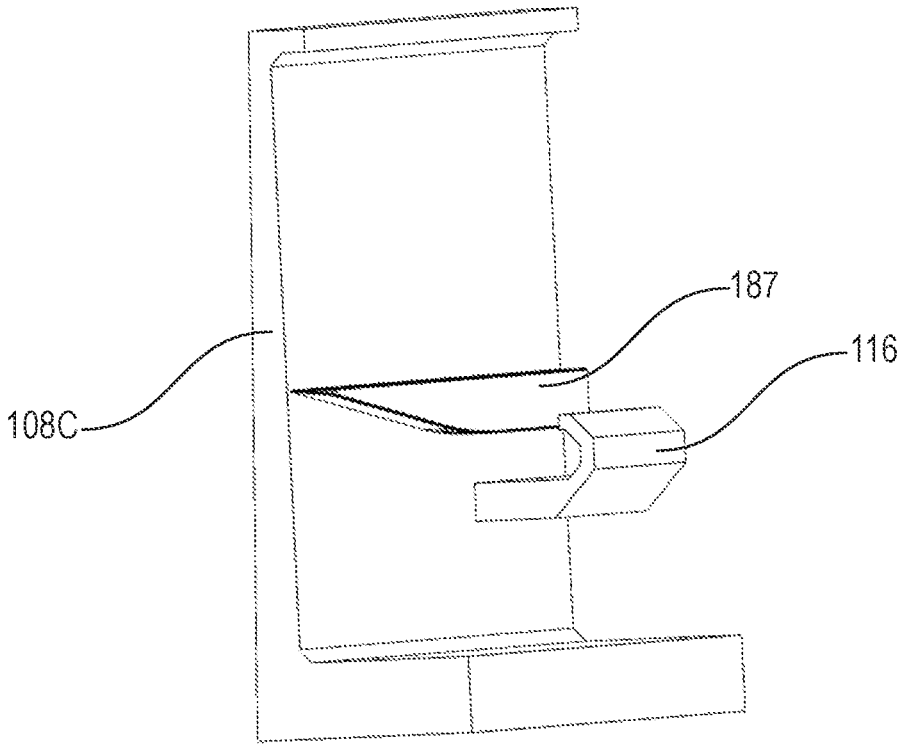
FIG. 16 illustrates a front, side perspective view of a guideway with a neutral fail-safe.
Figure 17:
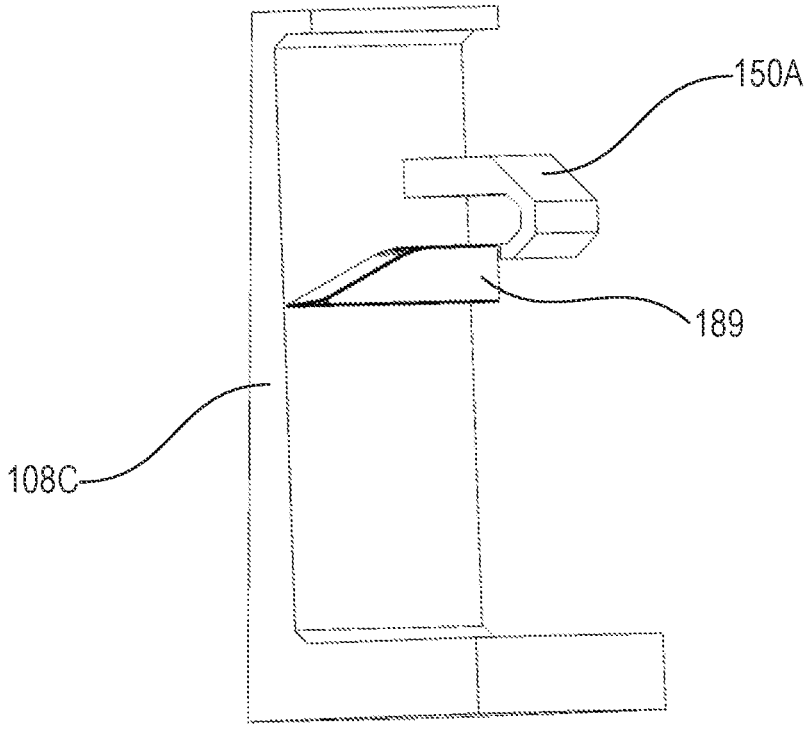
FIG. 17 illustrates a front, side perspective view of a guideway with a switch fail-safe.
Figure 18:
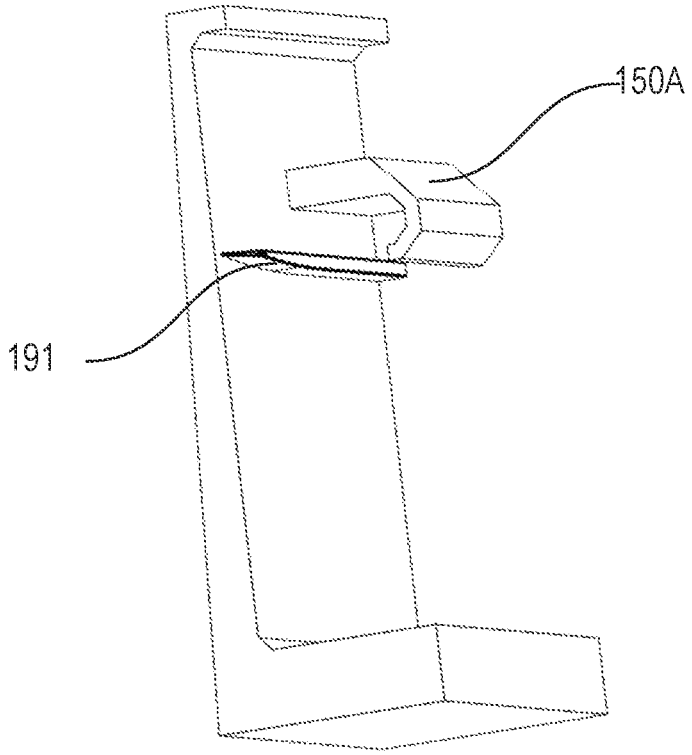
FIG. 18 illustrates a front, side perspective view of a guideway with a switch prevention ledge.

In order to switch from the active to neutral positions 199C, 199B, in one embodiment, as shown in FIGS. 16-18, the neutral rails 116, 134 and switch rails 150A, 150B may gradually ascend or descend, or there may be a failsafe rail, so that when the first and/or second set of switch wheels 196A-196B, 196C-196D come into contact therewith, the first and/or second set of switch wheels 196A-196B, 196C-196D will be engaged with the neutral or switch rails 116, 134, 150A, 150B. In particular, the first or second set of switch wheels 196A-196B, 196C-196D will be forced or pushed into the first or second position 197A, 197B. In FIG. 16, a neutral fail-safe 187 (e.g., a ledge), positioned in the first and/or second guideways 108A, 108B, that is angled downward to force the first and/or second set of switch wheels 196A-196B, 196C-196D into the neutral rails 116 or 134. In FIG. 17, a switch fail-safe 189 (e.g., a ledge), positioned in the first, second, and/or switch guideways 108A-108C, that is angled upward to force the first and/or second set of switch wheels 196A-196B, 196C-196D into the switch rails 150A, 150B. In FIG. 18, a switch prevention ledge 191, is positioned below or parallel with the switch hook 156 so as to keep the first and/or second set of switch wheels 196A-196B, 196C-196D from engaging with the switch guide rails 150A, 150B.

In an alternate embodiment, referring back to FIGS. 10-12, barcodes 195 may be used for moving the second axle 186B from the first to second position 197A, 197B or vice versa. As an example, barcodes 195 may be located near the first and second topsides 112D, 130D at an upper right track and may lead to varying outcomes based upon its code. Once the barcode is read, a signal may be sent to a controller that communicates with an actuator (e.g., a switching mechanism) to move the second axle 186B upward or downward. Other locations for the barcodes may be envisioned, such as on the bottom right track. With the barcodes, the vehicle will only change the position of the second axle if it is scanning an "Allow Switch" barcode. At that point, a signal may be sent to the vehicle to move the position of the second axle. If a "Require Neutral" barcode 195A is scanned the switch will be moved to neutral regardless of anything else, thereby moving the second axle 186B to the first position 197A, where the first and second set of switch wheels 196A-196B, 196C-196D engage with the first or second neutral rails 116, 134. If a "Require Switch" barcode 195B is scanned the switch will be moved to active regardless of anything else, thereby moving the second axle 186B to the second position 197B, where the first and second set of switch wheels 196A-196B, 196C-196D engage with the switch rails 150A, 150B.

When the vehicle 104 comprises more than one bogie 106, a connection (e.g., physical and/or electrical) may couple each bogie 106 so as to act as a single unit to move the first and second set of switch wheels 196A-196B, 196C-196D to the same position on each bogie. With more than one bogie, the first and second set of switch wheels 196A-196B, 196C-196D may be moved to the first or second position 197A, 197B via the above-mentioned switching mechanisms or by any other mechanism.

In some embodiments, the rapid transit system 100 may also include position barcodes 193 located, for example, near the first and second topsides at an upper left track. Other locations for the barcodes may be envisioned, such as on the bottom right track. Position barcodes may be used to determine exact location on the guideway 102. The length may be determined by track speed. Alternatively, or in conjunction with the position barcodes 193, the guideway may include markings or wireless transmitters for the purpose of locating vehicles on the guideway. Position barcodes 193 allow the vehicle to broadcast its position over radio and to a server/controller.

Sensors may be used in place of barcodes to communicate with a server and to control when the second axle 186B is raised or lowered. These sensors may include, but are not limited to, radio, radar, ultrasonic, infrared (beacons and sensors), lidar, and GPS. In some embodiments, the guideway 102 may include wireless data transmitters and receivers to allow vehicles 104A-104C to communicate with each other or a centralized control system, and to provide Internet access to passengers.

With the first set and second set of guide wheels 190A-190B, 198A-198B inside the tracks 110A-110D, 128A-128D, it allows the switch rails to be outside of the one or more neutral guide rails, allowing the first and second set of switch wheels 196A-196B, 196C-196D to be engaged continuously with the switch rails 150A, 150B during a switch. The rapid transit system allows the vehicle to switch between the first and second guideways 108A, 108B without changing position. The rapid transit system 100 can also greatly reduce the number of times the switch needs to change position, depending on the design of the track. This also allows for track designs where the vehicle is totally constrained into the track, which prevents derailments and allows the track to be operated upside down or sideways as discussed above.

The rapid transit system 100 may comprise a safety system. The safety system may have physical fail safes, such as a locking rail that prevents the second axle 186B position from being changed during a switch. In some embodiments, the second axle 186B that is not completely in the active position 199C will be pushed into the neutral position 199A before a switch. In some embodiments, the second axle 186B may be pushed into the neutral position 199A before an on-to switch. In some embodiments, the second axle 186B may be pushed into the active position 199C before a merge that requires it to be in the active position. Alternatively, in some embodiments, the rapid transit system 100 may comprise electrical interlocks, which prevents a switch if a vehicle is already in the switch on the other track. The electrical interlocks may also activate brakes if guideway is merging and there is a vehicle on the other guideway.

The rapid transit system 100 may comprise a terminal or intermediate stations, where passengers can embark or disembark, and cargo can be loaded or unloaded either manual or automatically. Maintenance may also be performed at the terminal or intermediate stations. In one embodiment, terminal or intermediate stations may be designed deliberately to collect vehicles with failed bogies (e.g., switching mechanisms) by including an active and neutral switch into the station.

Figure 19:
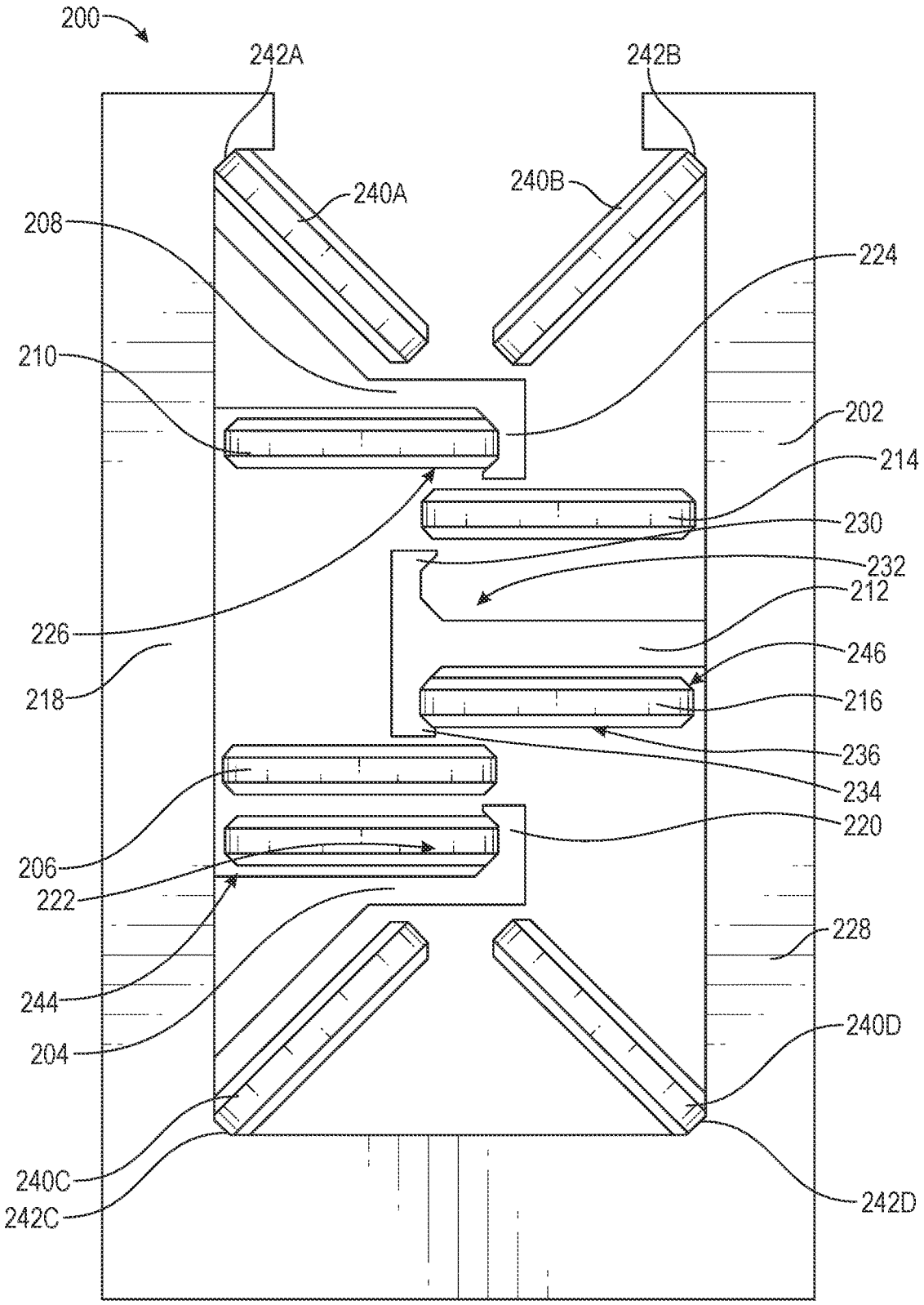
FIG. 19 illustrates a front elevation view of a guideway of a rapid transit system with a bogie positioned therein.
Figure 20:
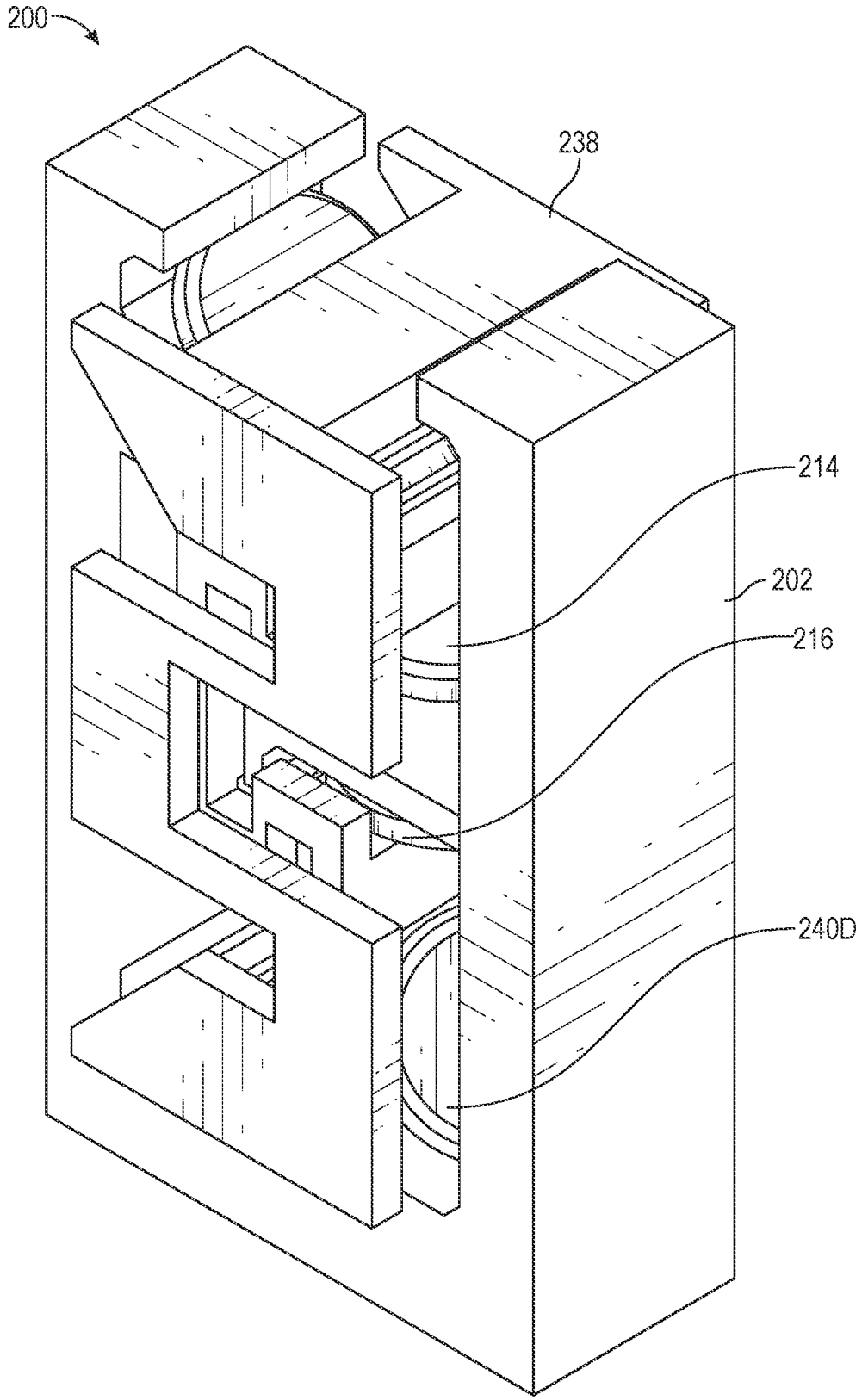
FIG. 20 illustrates a front, side perspective view of a guideway of a rapid transit system with a bogie positioned therein.
Figure 21:
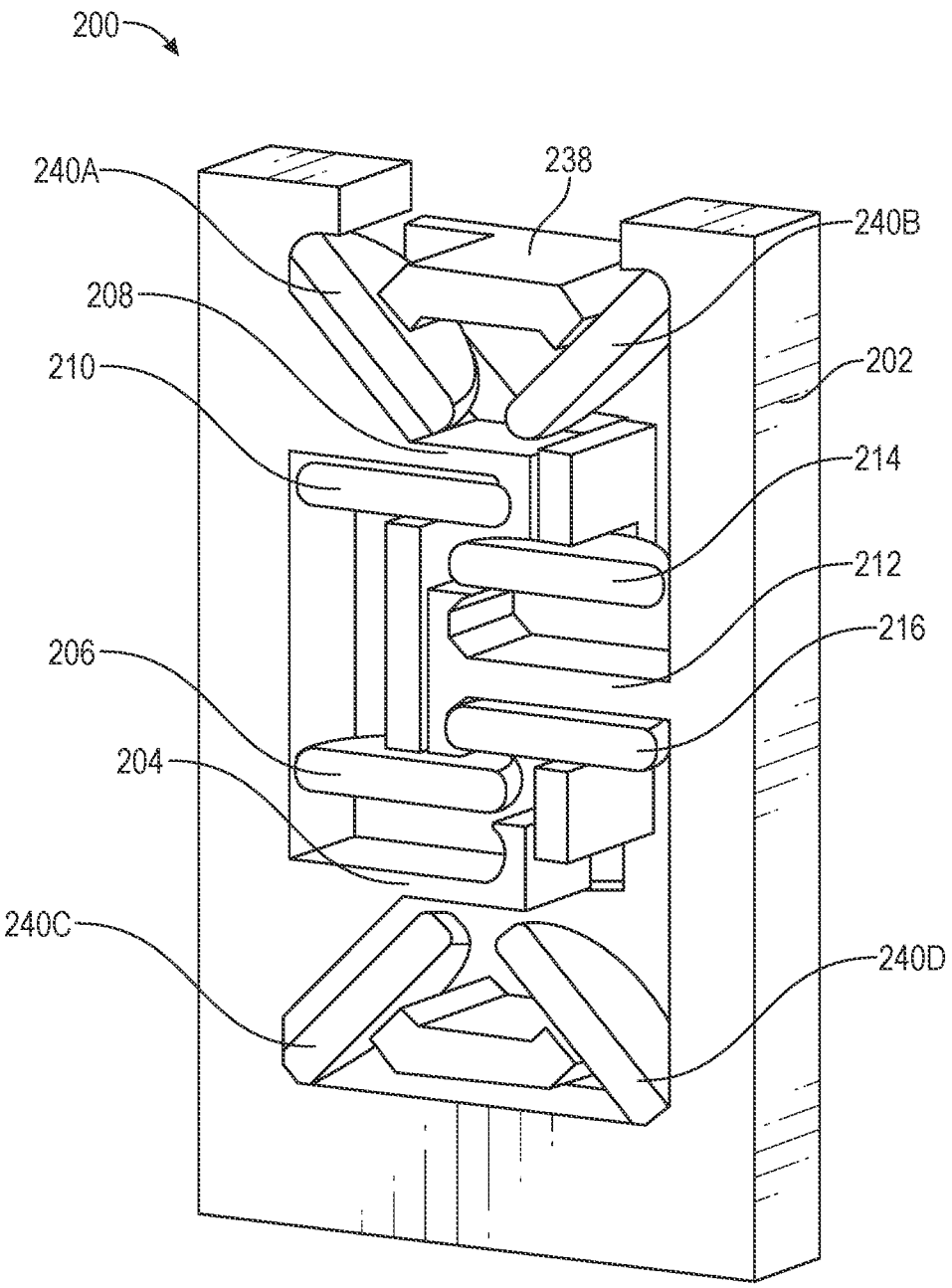
FIG. 21 illustrates a cutaway view of a guideway of a rapid transit system with a bogie positioned therein.

As shown in FIGS. 19-21, in one embodiment, a rapid transit system 200 may comprise a guideway 202, which may comprise one or more neutral guide rails 204 to interact with a first neutral wheel 206, one or more switch guide rails 208 to interact with a first switch wheel 210 and one or more combination guide rails 212 to interact with a second neutral wheel 214 and a second switch wheel 216. The neutral guide rail 204 may protrude from a first sidewall 218 of the guideway 202 and comprise a first neutral hook 220 that creates a first neutral channel 222 to receive the first neutral wheel 206. The switch guide rail 208 may protrude from the first sidewall 218, be positioned above the neutral guide rail 204, and comprise a first switch hook 224 that creates a first switch channel 226 to receive the first switch wheel 210. The combination guide rail 212 may protrude from a second sidewall 228 of the guideway 202 and comprise a first combination hook 230 that extends upward, creating a second neutral channel 232 to receive the second neutral wheel 214, and comprise a second combination hook 234 that extends downward, creating a second switch channel 236 to receive the second switch wheel 216. A vehicle bogie 238 may comprise the first neutral wheel 206, the first switch wheel 210, the second neutral wheel 214, the second switch wheel 216, and guide wheels 240A-240D that interact with guide rails or tracks 242A-242D in each corner of the guideway 202. The bogie 238 may be shaped so as to fit between the guide rails 204, 208, 212. When a bogie switch axle is in a first position 244 (e.g., downward position), the first neutral wheel 206 is engaged with the first neutral channel 222 and the second neutral wheel 214 is engaged with the second neutral channel 232. When the bogie switch axle is in a second position 246 (e.g., upward position), the first switch wheel 210 is engaged with the first switch channel 226 and the second switch wheel 216 is engaged with the second switch channel 236. It will be appreciated that the rapid transit system 200 may be used with the rapid transit system 100.

Figure 23:
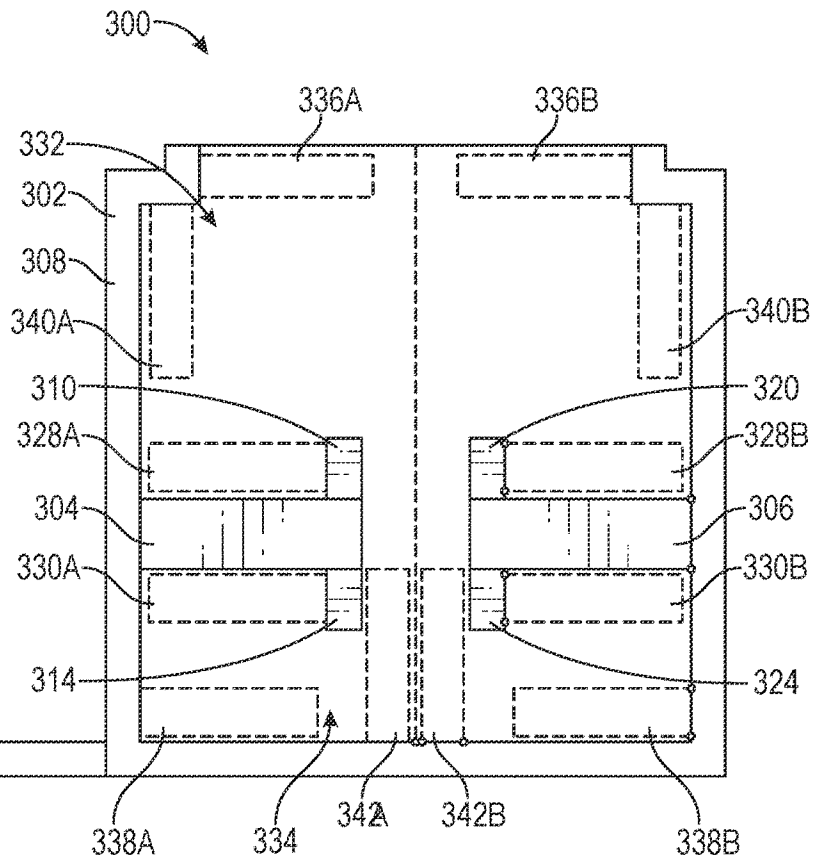
FIG. 23 illustrates a front elevation view of a guideway of a rapid transit system with wheels of a bogie positioned therein.
Figure 22:
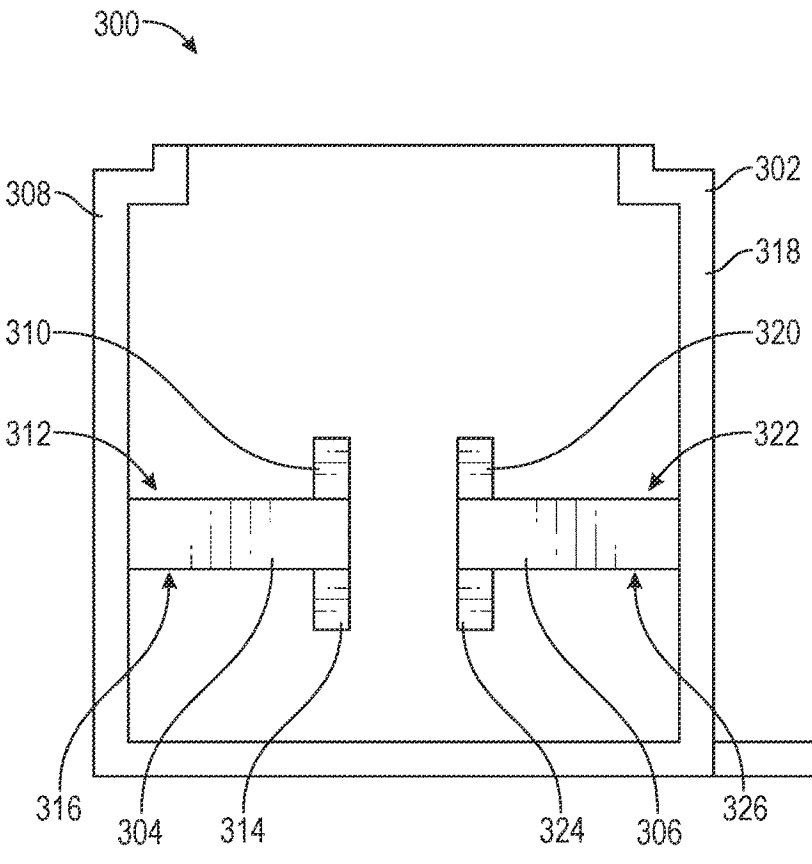
FIG. 22 illustrates a front elevation view of a guideway of a rapid transit system.

As shown in FIGS. 22-23, in one embodiment, a rapid transit system 300 may comprise a guideway 302, which may comprise first combination guide rail 304 and second combination guide rail 306. The first combination guide rail 304 may protrude from a first sidewall 308 and comprise a first neutral rail 310 on a first upper surface 312 and a first switch rail 314 on a first lower surface 316. The second combination guide rail 306 may protrude from a second sidewall 318 and comprise a second neutral rail 320 on a second upper surface 322 and a second switch rail 324 on a second lower surface 326. The first and second neutral rails 310, 320 may receive neutral wheels 328A, 328B that are coupled to a vehicle bogie. The first and second switch rails 314, 324 may receive switch wheels 330A, 330B that are coupled to the vehicle bogie. In addition, guide wheels that are coupled to the vehicle bogie may be positioned at an upper portion 332 of the guideway and a lower portion 334 of the guideway 302. A first set of horizontal guide wheels 336A, 336B may be placed in the upper portion 332 and a second set of horizontal guide wheels 338A, 338B may be placed in the lower portion 334, both sets contacting the first and second sidewalls 308, 318. Further, a first set of vertical wheels 340A, 340B may be positioned in the upper portion 332 and a second set of vertical guide wheels 342A, 342B may be positioned in the lower portion 334. It will be understood that the guide wheels, switch, and neutral rails may be in numerous configurations.

Figure 24:
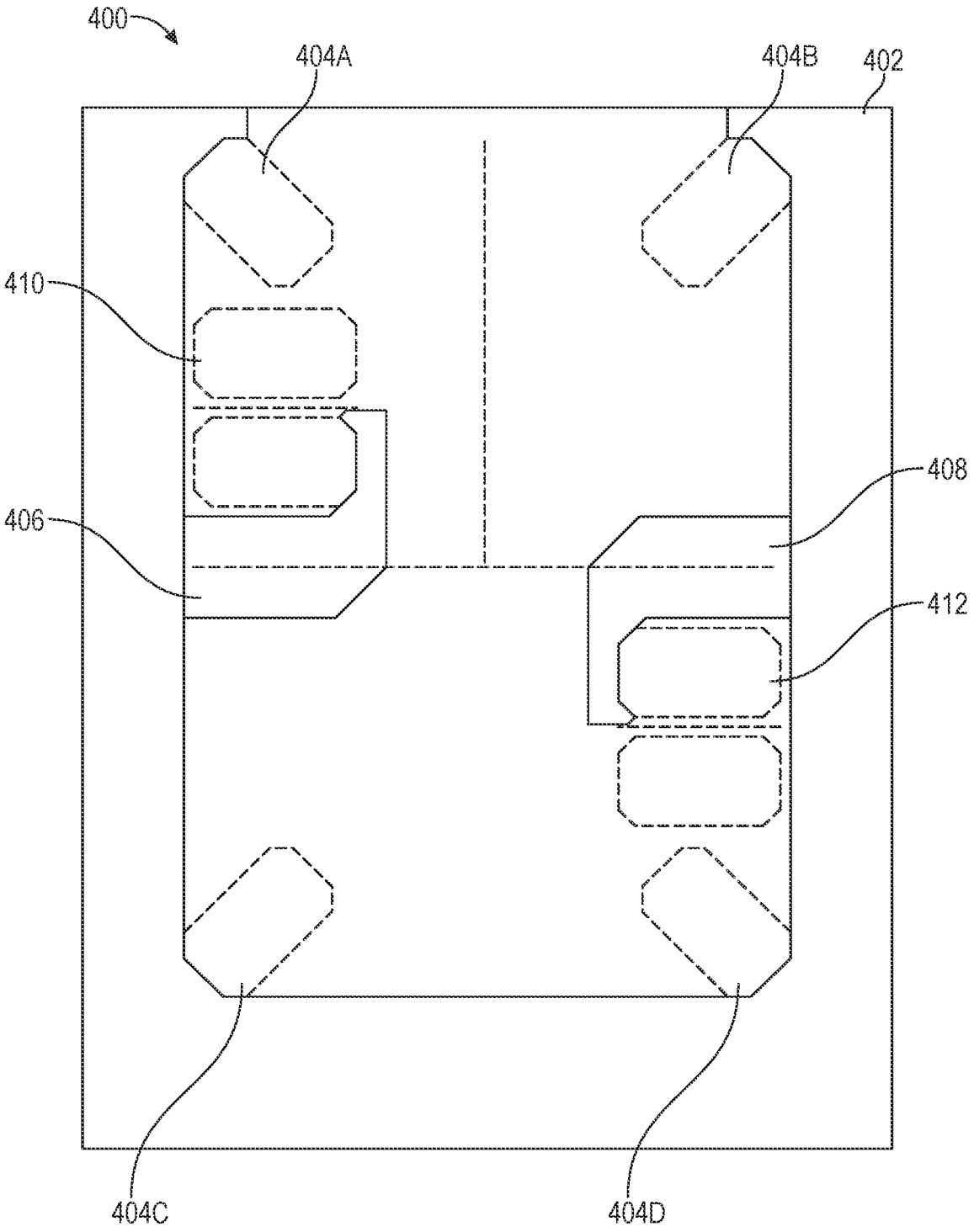
FIG. 24 illustrates a front elevation view of a guideway of a rapid transit system with wheels of a bogie positioned therein.
Figure 25:
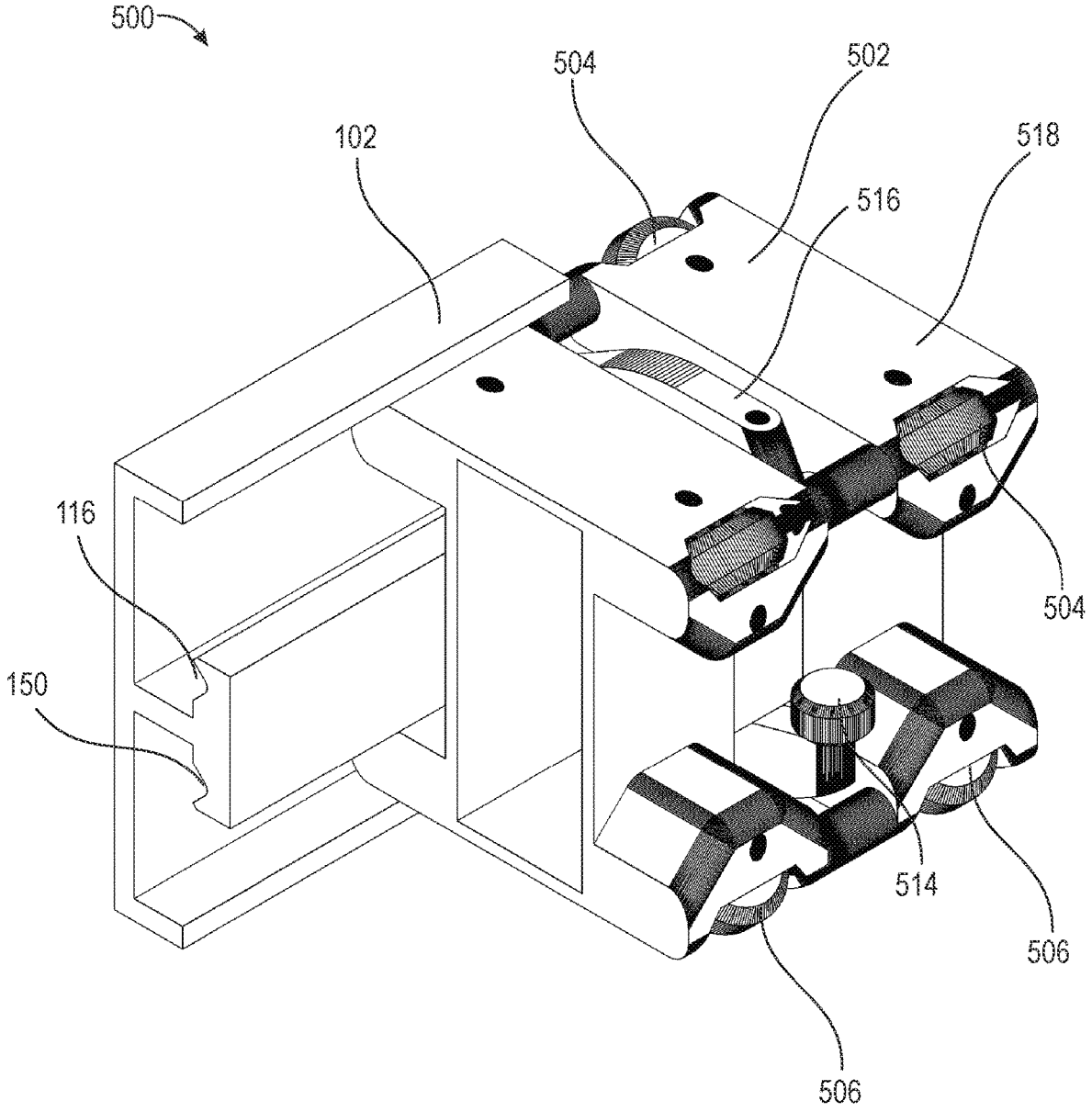
FIG. 25 illustrates a perspective view of a vehicle bogie in a guideway.
Figure 26:
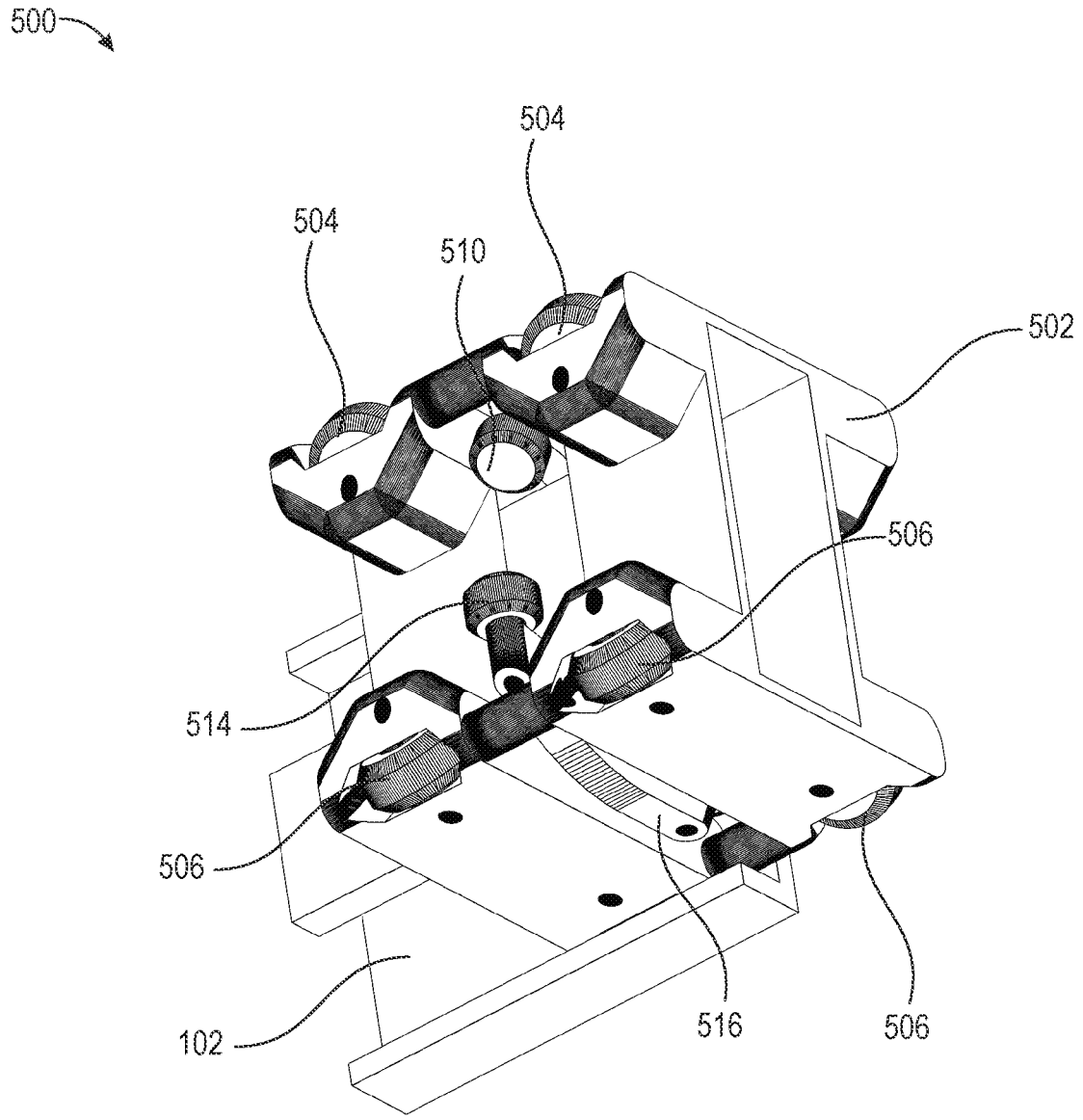
FIG. 26 illustrates a side, bottom perspective view of a vehicle bogie in a guideway.
Figure 27:
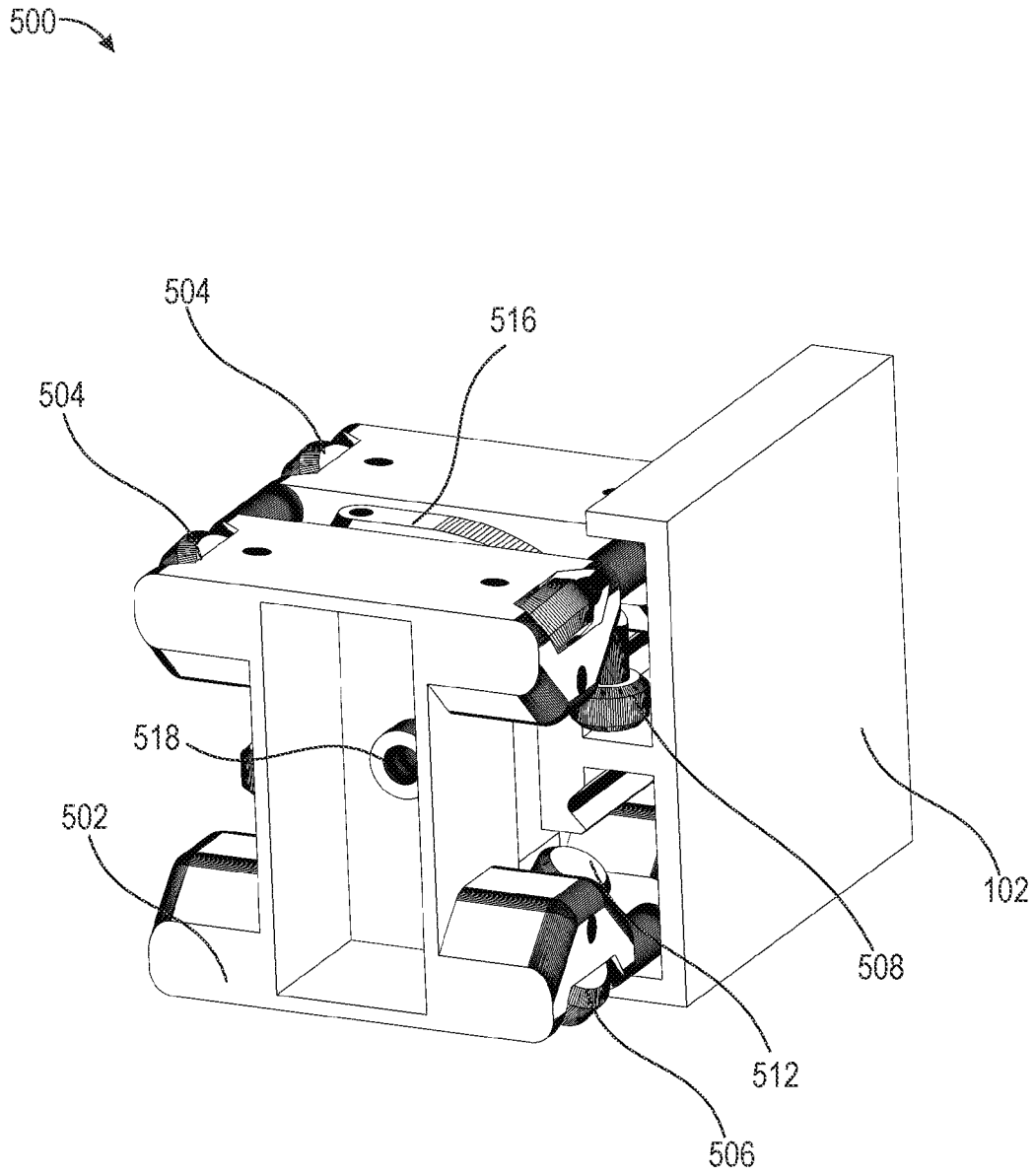
FIG. 27 illustrates a rear, top perspective view of a vehicle bogie in a guideway.
Figure 28:
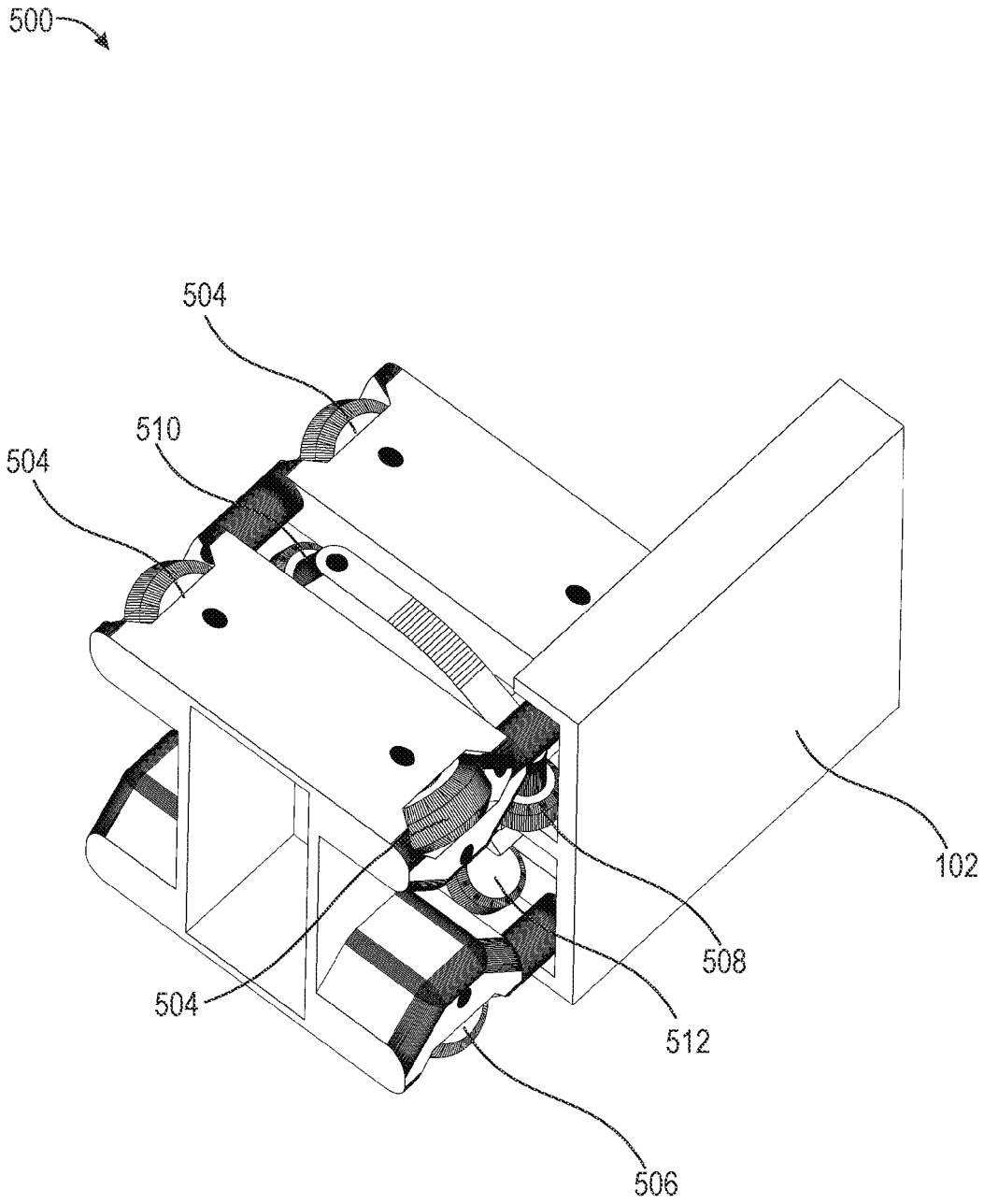
FIG. 28 illustrates a top perspective view of a vehicle bogie in a guideway.

As shown in FIG. 24, in one embodiment, a rapid transit system 400 may comprise a guideway 402 that may receive a vehicle bogie with a plurality of guide wheels 404A-404D. The guideway 402 may comprise a first switch guide rail 406 (e.g., switch to the left) and a second switch guide rail 408 (e.g., switch to the right). For example, a first switch wheel 410 may be positioned in the first switch guide rail 406 to move a vehicle to the left and a second switch wheel 412 when positioned in the second switch guide rail 408 may move the vehicle to the right.

As shown in FIGS. 25-28, in one embodiment, a rapid transit system 500 comprises a vehicle bogie 502. The vehicle bogie 502 may comprise upper guide wheels 504 (e.g., four upper wheels) and lower guide wheels 506 (e.g., four lower wheels). The upper guide wheels 504 and the lower guide wheels 506 may be positioned in the guideway 102 to move a vehicle down the guideway 102. In some embodiments, the upper guide wheels 504 and the lower guide wheels 506 may be angled in relationship to the sidewalls of the guideway 102 so as to contact the angled corners of the guideway 102. In other embodiments, the upper guide wheels 504 and lower guide wheels 506 may be parallel to the sidewalls of the guideway 102. The guideway 102 may be located at, above, or below grade, capable of fully or partially constraining the vehicle bogie 502.

The guideway 102 may be designed so that it wraps around the vehicle bogie 502. The guideway 102 may comprise the neutral guide rail 116 and switch guide rail 150. The vehicle bogie 502 may further comprise a first upper switch wheel 508, a second upper switch wheel 510, a first lower switch wheel 512, and a second lower switch wheel 514. The switch wheels 508, 510, 512, 514 may be coupled to a support frame 516.

The support frame 516 may receive the first upper switch wheel 508, the second upper switch wheel 510, the first lower switch wheel 512, and the second lower switch wheel 514. In some embodiments, the support frame 516 may be an I-shaped frame positioned inside of the vehicle bogie 502 between guide wheels. The support frame 516 may be coupled to the vehicle bogie 502 via a bearing 518. It will be understood that while a bearing 518 is shown, any other rotating mechanism may be used. The support frame 516 via the bearing 518 may be pivotally coupled to the vehicle bogie 502.

Figure 31:
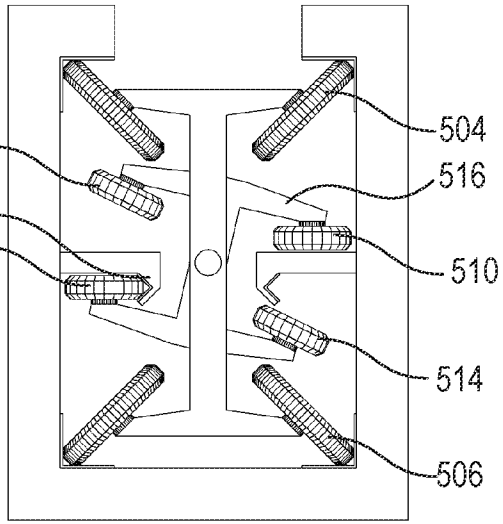
FIG. 31 illustrates a front elevation view of a bogie in a guideway.
Figure 30:
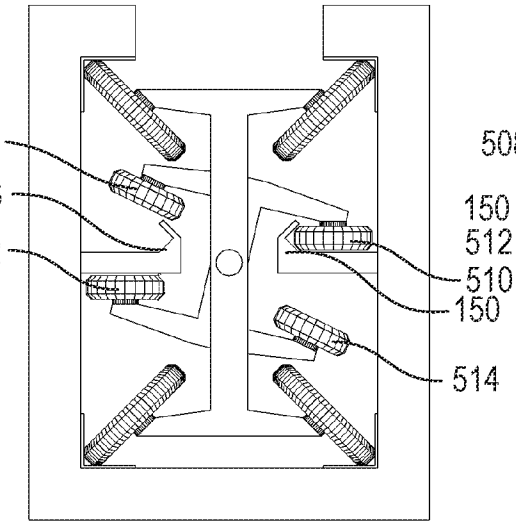
FIG. 30 illustrates a front elevation view of a bogie in a guideway.
Figure 29:
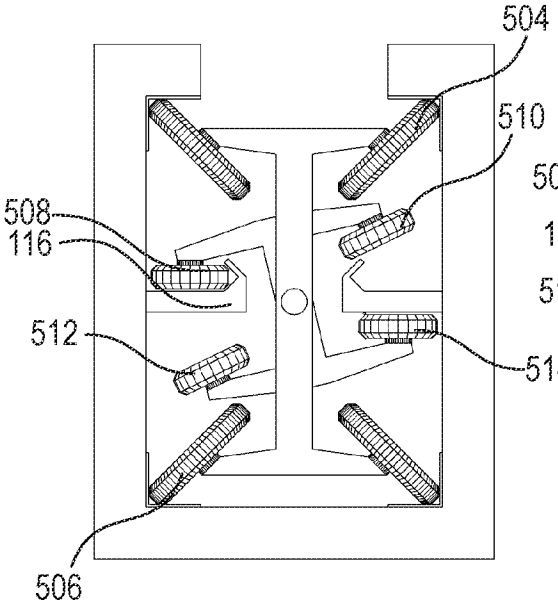
FIG. 29 illustrates a front elevation view of a bogie in a guideway.

As shown in FIGS. 29-31, due to the support frame 516 being able to pivot, the first upper switch wheel 508, the second upper switch wheel 510, the first lower switch wheel 512, and the second lower switch wheel 514 may engage neutral or switch guide rails 116, 150 depending on the position of the support frame 516. The support frame 516 may be in a first, resting position when it is level with an upper surface 518 of the vehicle bogie 502. When the support frame 516 pivots to a second position, the first upper switch wheel 508 and/or the second lower switch wheel 514 may contact and engage with the neutral guide rail 116, thereby moving the vehicle into a neutral position (FIG. 29). When the support frame 516 pivots to a third position, the second upper switch wheel 510 and/or the first lower switch wheel 512 may contact and engage with the switch guide rail 150, thereby moving the vehicle into a switch position and to another guideway, either right or left switch (FIGS. 30-31). Accordingly, to move down a guideway, the support frame 516 may be in the second position, engaged with the neutral guide rail 116. It will be appreciated that in some embodiments, the second position and third position may be switched. That is, in some embodiments, the second position may be when the first upper switch wheel 508 and/or the second lower switch wheel 514 may contact and engage with the switch guide rail 150 and the third position may be when the second upper switch wheel 510 and/or the first lower switch wheel 512 may contact and engage with the neutral guide rail 116. Similar to other embodiments herein, the support frame 516 may move from the first position to the second or third position via a motor or any other mechanism. It will be appreciated that elements of the rapid transit system 500 may be combined with any previously mentioned embodiment.

It will be understood that while various embodiments have been disclosed herein, other embodiments are contemplated. Further, systems and/or methods according to certain embodiments of the present disclosure may include, incorporate, or otherwise comprise properties or features described in other embodiments. Consequently, various features of certain embodiments can be compatible with, combined with, included in, and/or incorporated into other embodiments of the present disclosure. Therefore, disclosure of certain features or components relative to a specific embodiment of the present disclosure should not be construed as limiting the application or inclusion of said features or components to the specific embodiment unless stated. As such, other embodiments can also include said features, components, members, elements, parts, and/or portions without necessarily departing from the scope of the present disclosure.

The embodiments described herein are examples of the present disclosure. Accordingly, unless a feature or component is described as requiring another feature or component in combination therewith, any feature herein may be combined with any other feature of a same or different embodiment disclosed herein. Although only a few of the example embodiments have been described in detail herein, those skilled in the art will appreciate that modifications are possible without materially departing from the present disclosure described herein. Accordingly, all modifications may be included within the scope of this invention.

What is claimed is:

1. A rapid transit system comprising:

a plurality of guideways comprising stationary guide rails;

a vehicle comprising a bogie with a support frame that is moveable on a y-axis, the bogie comprising a plurality of guide wheels, the support frame comprising at least one first switch wheel and at least one second switch wheel;

wherein when the at least one first switch wheel and the at least one second switch wheel are in a first position in a guideway of the plurality of guideways via the movement of the support frame on a y-axis, the bogie is in a neutral position;

wherein when the at least one first switch wheel and the at least one second switch wheel are in a second position in the guideway via the movement of the support frame on a y-axis, the bogie is in a switch position.

2. The rapid transit system of claim 1, wherein the plurality of guideways comprises a first guideway, a second guideway, and a switch guideway interposed between the first guideway and the second guideway.

3. The rapid transit system of claim 2, wherein the stationary guide rails comprise one or more first neutral guide rails on the first guideway.

4. The rapid transit system of claim 3, wherein the one or more first neutral guide rails comprise a first protrusion.

5. The rapid transit system of claim 4, wherein the first protrusion comprises a first hook that creates a first protrusion aperture and a first protrusion channel.

6. The rapid transit system of claim 2, wherein the first guideway comprises first tracks that receive the plurality of guide wheels.

7. The rapid transit system of claim 2, wherein the second guideway comprises second tracks that receive the plurality of guide wheels.

8. The rapid transit system of claim 2, wherein the second guideway comprises one or more second neutral guide rails.

9. The rapid transit system of claim 8, wherein the one or more second neutral guide rails comprise a second protrusion.

10. The rapid transit system of claim 9, wherein the second protrusion comprises a second hook that creates a second protrusion aperture and a second protrusion channel.

11. The rapid transit system of claim 2, wherein the stationary guide rails comprise two or more switch guide rails on the switch guideway.

12. The rapid transit system of claim 11, wherein the two or more switch guide rails comprise a first switch guide rail and a second switch guide rail.

13. The rapid transit system of claim 1, wherein the plurality of guideways comprises wireless data transmitters and receivers that allow the vehicle to communicate with other vehicles and a centralized control system.

14. The rapid transit system of claim 1, wherein the first position comprises the at least one first switch wheel and the at least one second switch wheel in a downward position.

15. The rapid transit system of claim 1, wherein the second position comprises the at least one first switch wheel and the at least one second switch wheel in an upward position.

16. A rapid transit system comprising:

a plurality of guideways;

a vehicle comprising one or more bogies, the one or more bogies comprising:

a support frame pivotally coupled to the bogie, the support frame comprising a first upper switch wheel, a second upper switch wheel, a first lower switch, and a second lower switch wheel;

wherein when the support frame moves from a first, resting position to a second position, the vehicle is in a neutral position;

wherein when the support frame moves from the first, resting position to a third position, the vehicle is in a switch position.

17. The rapid transit system of claim 16, wherein the neutral position comprises the vehicle moving down a guideway of the plurality of guideways.

18. The rapid transit system of claim 16, wherein the switch position comprises the vehicle moving to a switch guideway to change from a guideway to another guideway.

19. A rapid transit system comprising:

one or more vehicle bogies comprising a support frame coupled to the bogie and moveable on a y-axis, the support frame comprising at least four switch wheels;

wherein when the support frame moves on a y-axis, the one or more vehicle bogies are in a neutral or switch position.

* * * * *